US010758047B2

(12) United States Patent
Brensinger et al.

(10) Patent No.: US 10,758,047 B2
(45) Date of Patent: Sep. 1, 2020

(54) SWINGING CHAIR WITH AUTO-RECLINING FEATURE

(71) Applicant: NEMO EQUIPMENT, INC., Dover, NH (US)

(72) Inventors: Camon Brensinger, Stratham, NH (US); Patrick McCluskey, Lee, NH (US)

(73) Assignee: Nemo Equipment, Inc., Dover, NH (US)

( * ) Notice: Subject to any disclaimer, the term of this patent is extended or adjusted under 35 U.S.C. 154(b) by 0 days.

(21) Appl. No.: 15/879,612

(22) Filed: Jan. 25, 2018

(65) Prior Publication Data

US 2019/0357683 A1 Nov. 28, 2019

Related U.S. Application Data

(60) Provisional application No. 62/450,267, filed on Jan. 25, 2017.

(51) Int. Cl.

| | |
|---|---|
| ***A47C 3/025*** | (2006.01) |
| ***A47C 4/30*** | (2006.01) |
| ***A47C 4/02*** | (2006.01) |
| ***A47C 4/28*** | (2006.01) |

(52) U.S. Cl.

CPC ..... *A47C 3/0255* (2013.01); *A47C 4/02* (2013.01); *A47C 4/286* (2013.01); *A47C 4/30* (2013.01)

(58) Field of Classification Search

CPC ..... A47C 4/30; A47C 1/14; A47C 3/0255; A47C 7/14; A47C 7/40; A47C 4/286; A47C 4/02; A47D 13/107

USPC ..... 297/273, 45, 51, 440.11, 16.1, 277

See application file for complete search history.

(56) References Cited

U.S. PATENT DOCUMENTS

| | | | | |
|---|---|---|---|---|
| 148,586 A * | 3/1874 | Wethered | ..... | A47C 3/0255 297/277 |
| 392,112 A * | 10/1888 | Farwell | ..... | A47C 3/0255 297/277 |
| 4,351,524 A * | 9/1982 | Gomes | ..... | A47C 3/0255 248/188 |
| 5,842,741 A * | 12/1998 | Onorini | ..... | A47C 3/0255 297/281 |
| 8,646,835 B2 * | 2/2014 | Homans | ..... | A47C 4/02 297/16.1 |

FOREIGN PATENT DOCUMENTS

| | | | | |
|---|---|---|---|---|
| GB | 190324007 A * | 1/1904 | | |
| WO | WO-0040121 A1 * | 7/2000 | ..... | A47C 3/0255 |

* cited by examiner

*Primary Examiner* — Milton Nelson, Jr.

(57) ABSTRACT

A swinging chair comprises a frame portion and a seat portion designed to hang within the frame portion. The frame portion comprises a plurality of rigid segments, which are connected by a hub and from which is hung the chair seat portion. In one embodiment, the frame is comprised of multiple segments which can be taken apart for ease of storage and packing while the seat portion may be made of a soft, pliable cloth like material which is supported by a number of straps coupled to two buckles that fit over a knob or other protrusion in the upright seat support frame portion for providing automatic reclining of the chair seat back portion.

20 Claims, 20 Drawing Sheets

SWINGING CHAIR WITH AUTO-RECLINING FEATURE

CROSS-REFERENCE TO RELATED APPLICATIONS

This application claims priority from U.S. Provisional Patent Application No. 62/450,267, titled "HANGING CHAIR", which was filed on Jan. 25, 2017 which is incorporated fully herein by reference.

TECHNICAL FIELD

The present invention relates to chairs for use outdoors and indoors and more particularly, relates to a swinging chair, with an optional auto-reclining feature, made of a hard material such as wood or plastic or a lightweight material such as fabric or leather that hangs from and within a lightweight, freestanding frame, and wherein in one embodiment, the entire chair seat and frame can be folded or transformed into a compact package for use in outdoor camping, backpacking, beach and other outdoor or indoor activities where a transformable, compact and comfortable chair is desirable.

BACKGROUND INFORMATION

Campers, hikers, backpackers and others who pursue outdoor activities desire and enjoy the ability to sit down comfortably once they arrive at their final destination or at some intermediate point. Current folding or otherwise transforming chairs do not offer the swinging action or auto-reclining feature desired by users. Some current chairs are rocking chairs, but rocking is not well suited for use on the bumpy, uneven terrain typical of the outdoors and is a very different as action and feeling from a hanging chair. In addition, users of chairs indoors or in a patio setting also desire and new sitting experience that is comfortable, enjoyable and adjustable.

Accordingly, what is needed is a portable (in some instances), swinging chair that can be set up on terrain typically found at camping sites or at the beach and providing a chair offering the experience of both upright sitting and reclining. Such a needed chair should interface with the ground by static legs similar to ordinary chairs while providing the dynamic action of swinging that happens between the frame and the hammock-like suspended chair portion, allowing the swinging to take place independent of the terrain. Further, this new solution should, if desired, be easy to disassemble or transform, be lightweight and pack small.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
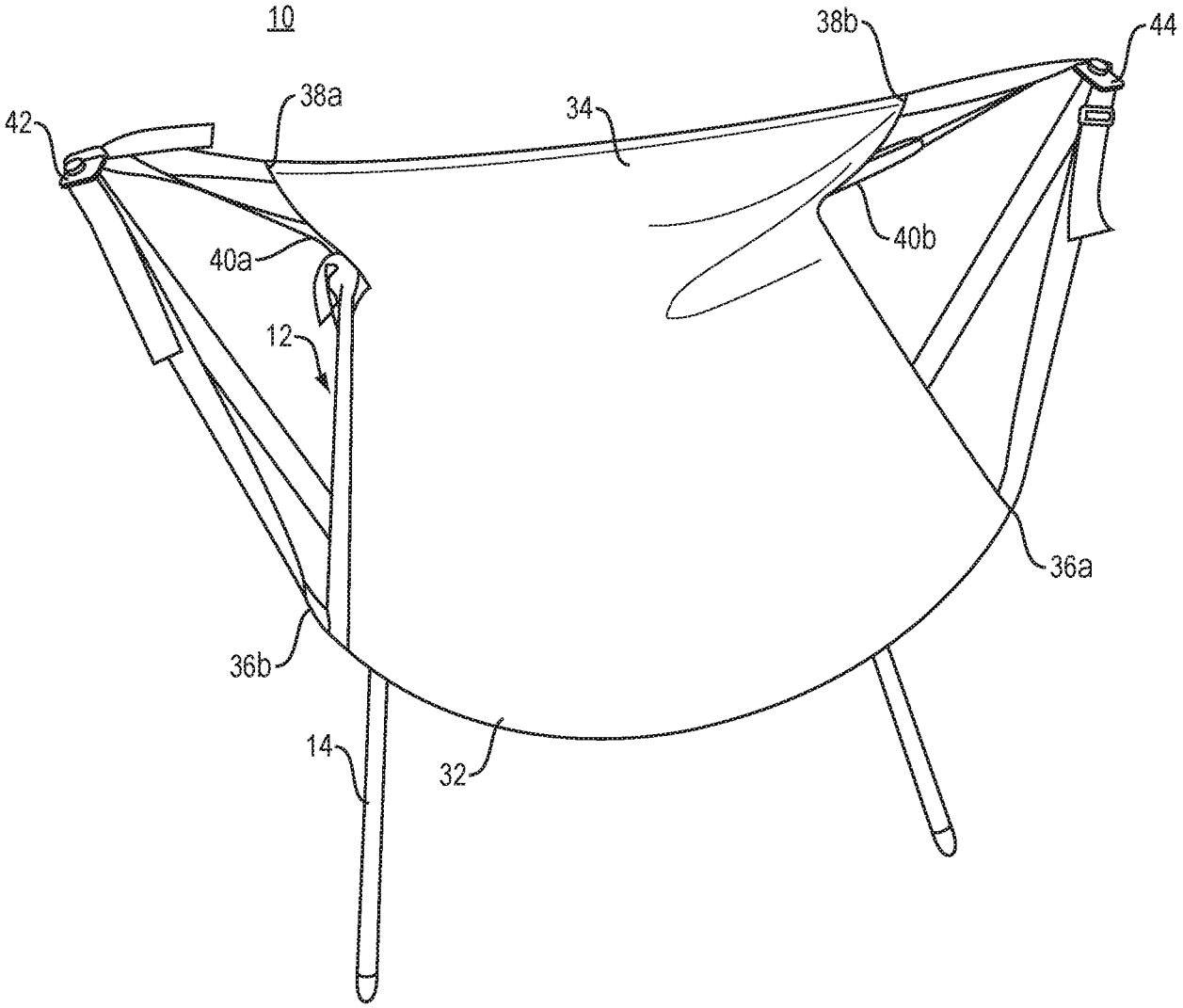
FIG. 1 is front perspective view of the swinging chair according to the present invention.

The present invention features a swinging chair 10, FIG. 1, having a swinging seat portion 12. In one embodiment, the swinging seat portion 12 is made of a lightweight, pliable material such as woven or knit fabric, mesh, or leather. In another embodiment, the swinging seat portion 12 may be made of a more rigid, non-pliable material such as wood, plastic or composite material.

The seat portion 12 hangs from a lightweight and strong freestanding frame 14 (FIG. 2 for example) typically made of aluminum tubing having cross sectional widths in the range of 0.25 to 5.0 inches. The frame 14 is termed "rigid" however the frame 14 exhibits the properties of being free standing and able to support the weight of a person in the chair but is in fact also flexible to some extent, as is generally found in materials such as aluminum. The aluminum material may have a shape other than circular such as elliptical or square for example and generally has a wall thickness of approximately 0.05 to 0.5 inches. Other suitable materials such as metals, metal alloys, polymers, polymer composites, wood, ceramics or any combination thereof are contemplated and considered to be within the scope of the present invention.

Figure 2A:
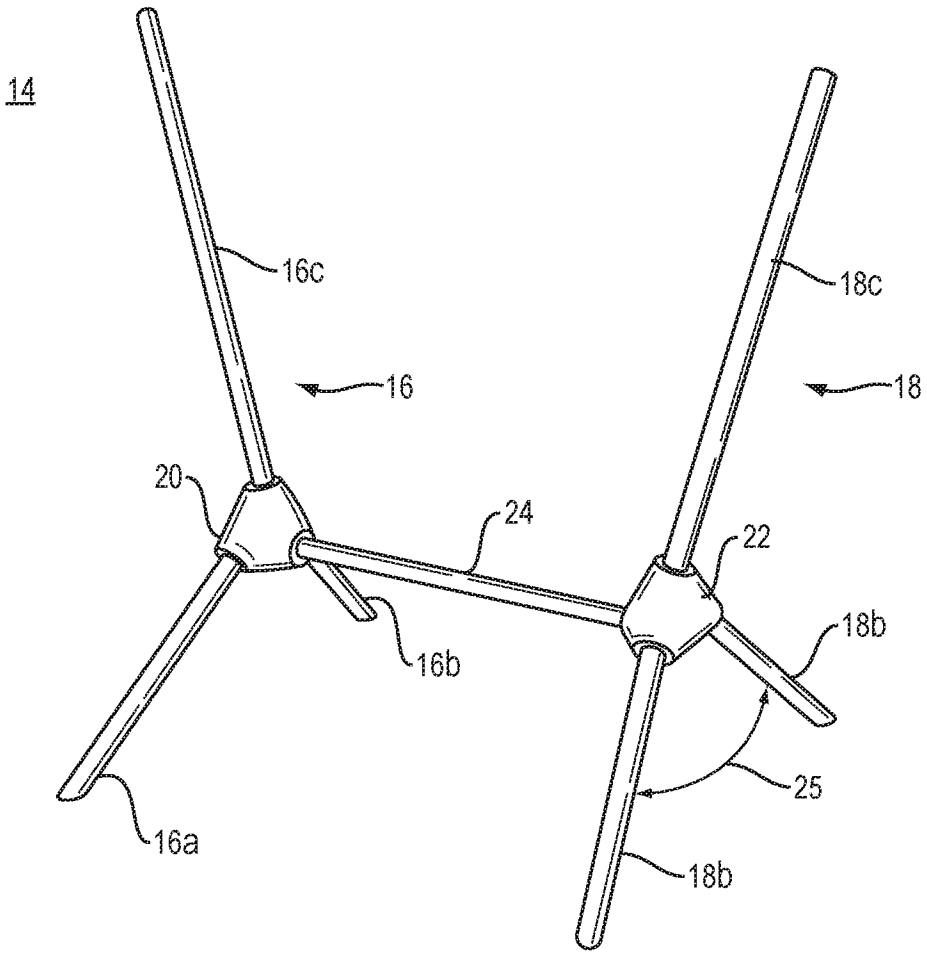
FIG. 2A is a perspective view of the swinging chair frame according to one aspect of the invention.
Figure 2B:
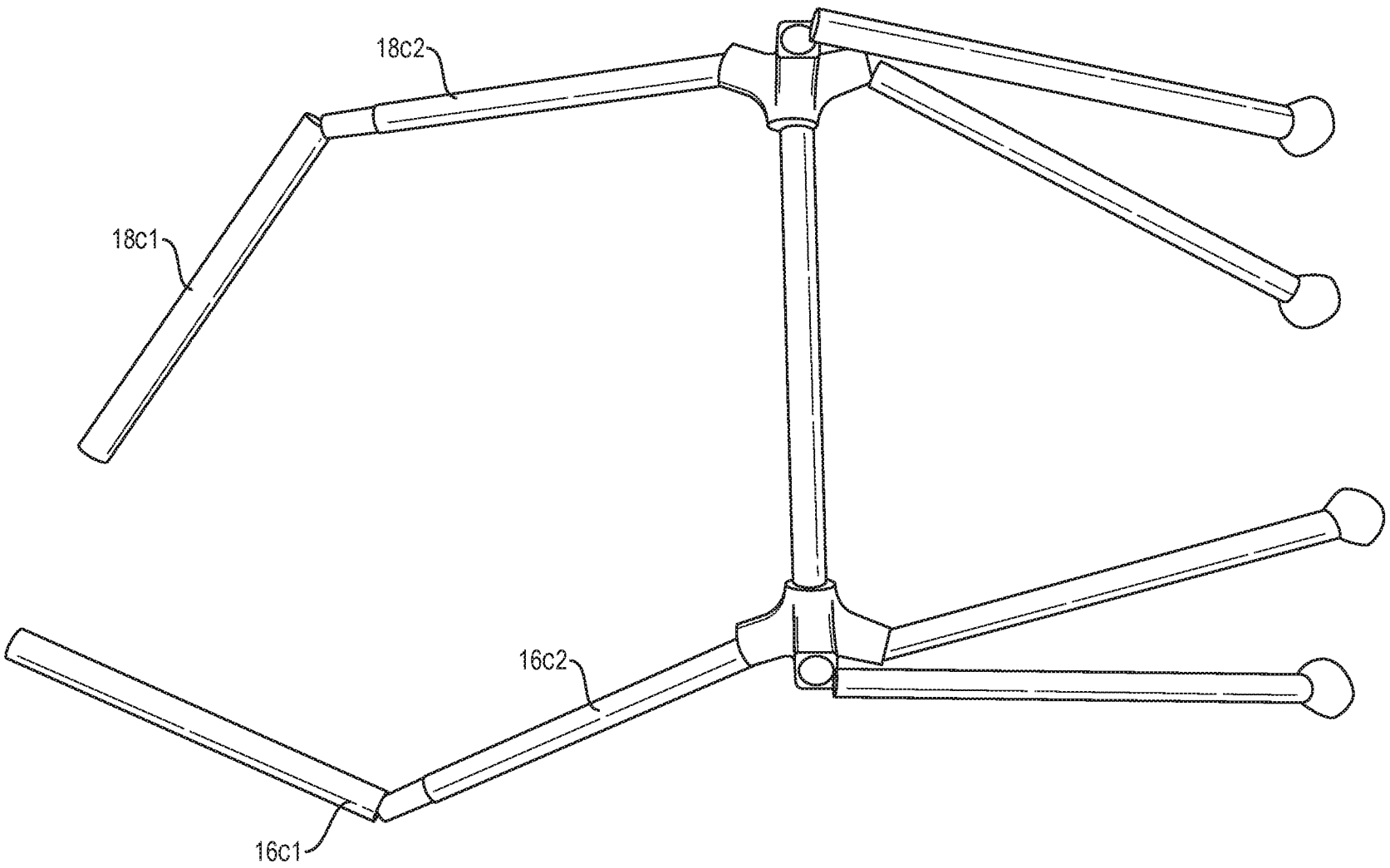
FIG. 2B is a perspective view of an alternative embodiment of the swinging chair frame according to one aspect of the present invention.

The frame 14, FIG. 2, is, in one embodiment, preferably formed by seven (7) segments: a first three (3) segment portion 16 including one set of two legs (16*a* and 16*b*) and upright chair support member (16*c*); and a second three (3) segment portion 18 forming a second set of two legs (18*a*, 18*b*) and upright chair support member 18*c*. In another embodiment, in order to make the frame 14 more portable and packable, the upright chair support members 16*c* and 18*c* may each be provided as two interconnecting segments (16*c*1, 16*c*2, 18*c*1 and 18*c*2, FIG. 2A) to provide more portability and packability for the chair. Each individual segment 16*c*1/16*c*2 and 18*c*1/18*c*2 may be connected together to the corresponding adjacent segment by an elastic shock cord as is commonly found in tent frames. Each individual upright support member segment 16*c*1, 16*c*2, 18*c*1 and 18*c*2 may be roughly the same length to provide for easy packing.

In another embodiment of a less portable and non-packable chair, the frame 14 may not break down but may be formed of a welded steel or aluminum frame, molded carbon fiber or composite, or the like.

In one of the embodiments disclosed herein, the first three segments 16 are held together in place by a first "hub" 20, while the second three segments 18 are held together and in place by a second identical "hub" 22. A "crossbar" spacer segment 24 keeps the first and second hubs 20, 22 and accompanying segments 16/18 in a fixed relationship (i.e. a fixed distance) from one another.

Each "hub" 20/22 (shown in greater detail in FIGS. 5A-5E) are manufactured from metals, metal alloys, polymers, polymer composites, wood, ceramics or any composite material that can be used to fabricate the hubs 20/22, all considered to be within the knowledge of those skilled in the art and within the scope of the present invention.

Figure 3:
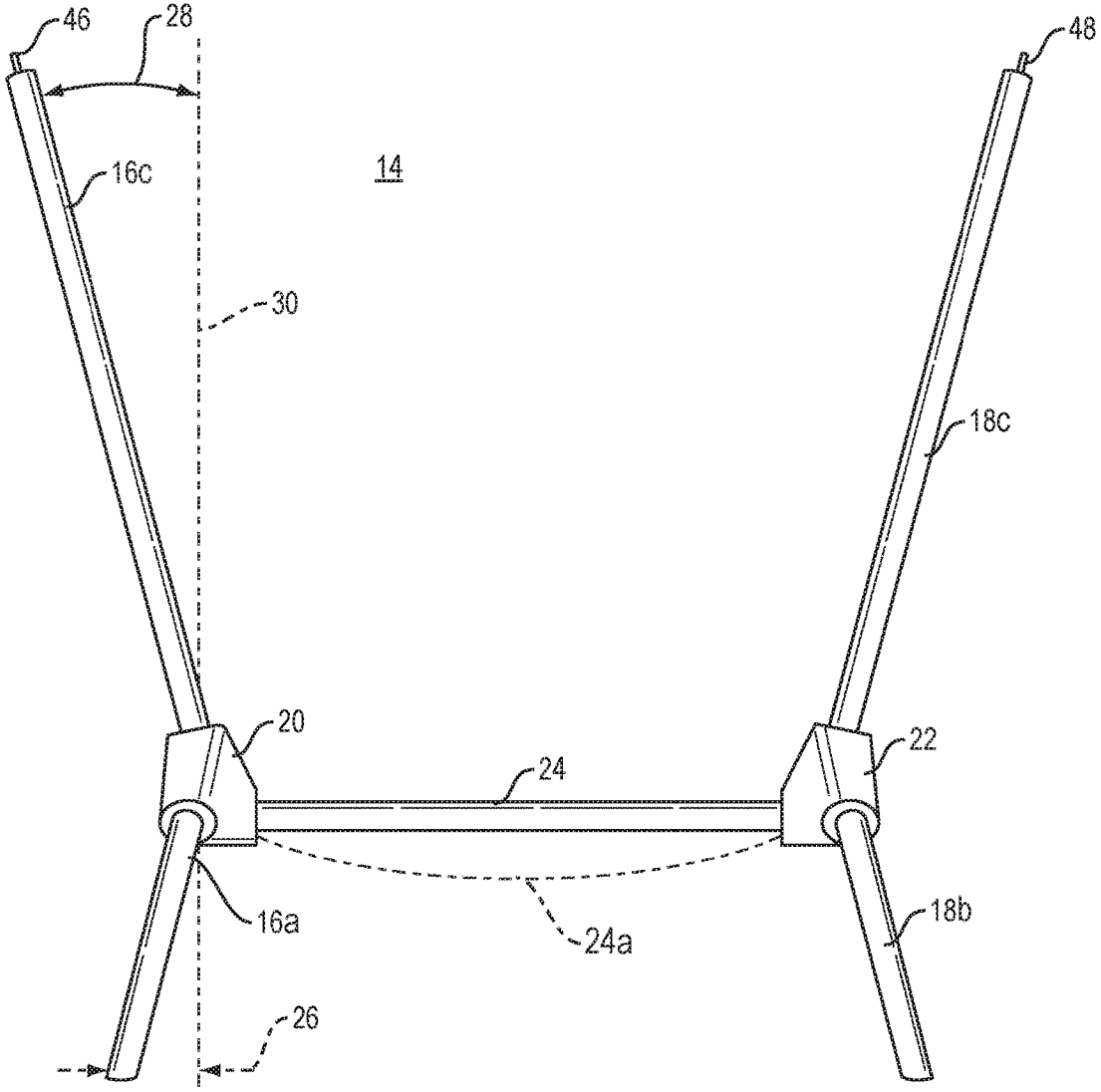
FIG. 3 is a front view of the swinging chair frame according to the invention.
Figure 4:
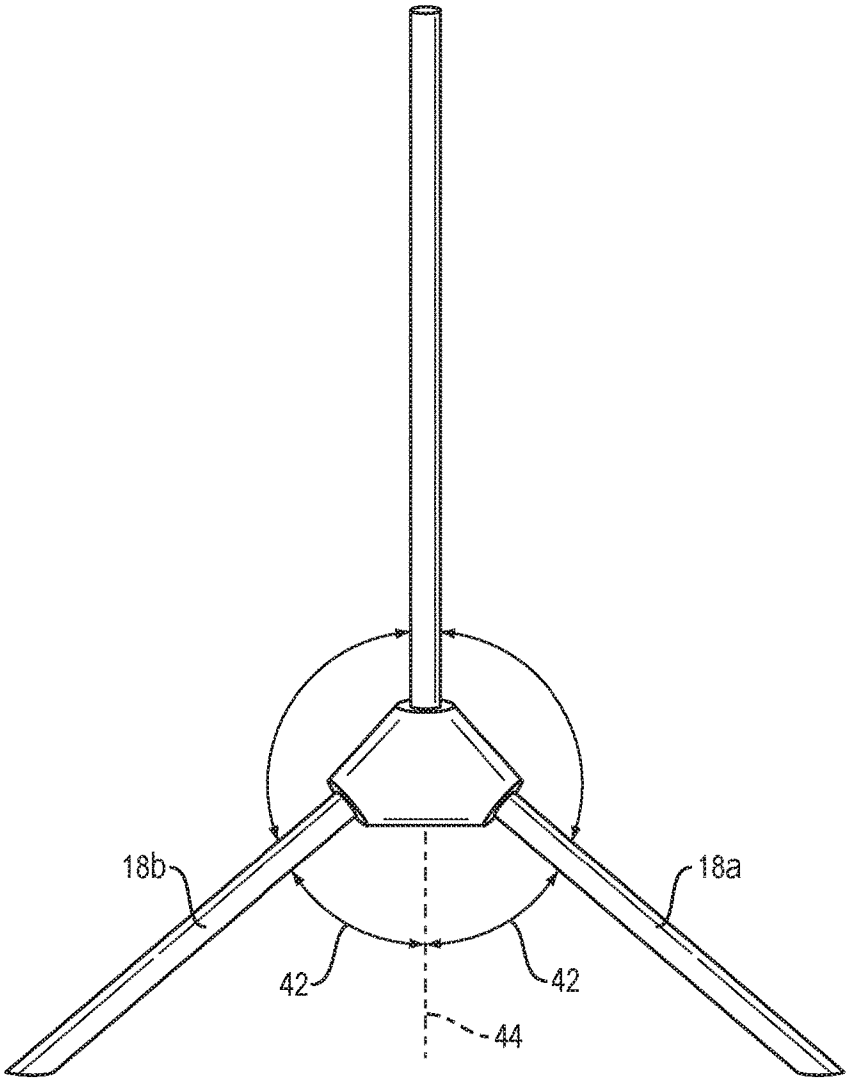
FIG. 4 is a side view of the swinging chair frame according to the invention.
Figure 5A:
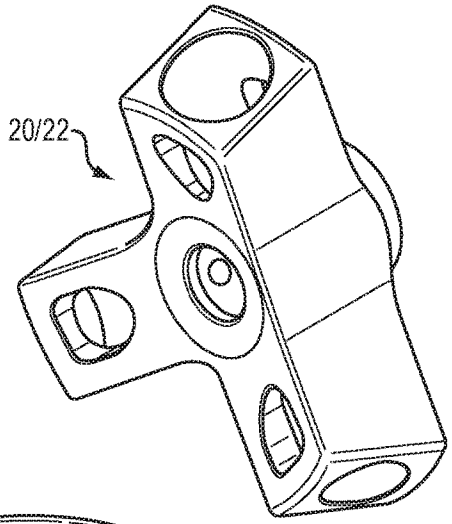
FIGS. 5A-5E are perspective views of the swinging chair frame hub connector according to one feature of the present invention.
Figure 5B:
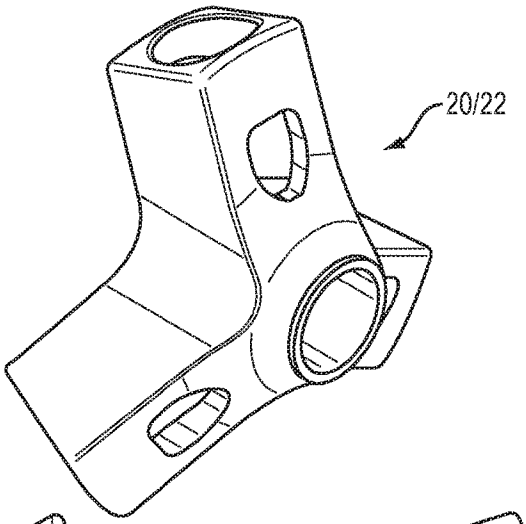
Figure 5C:
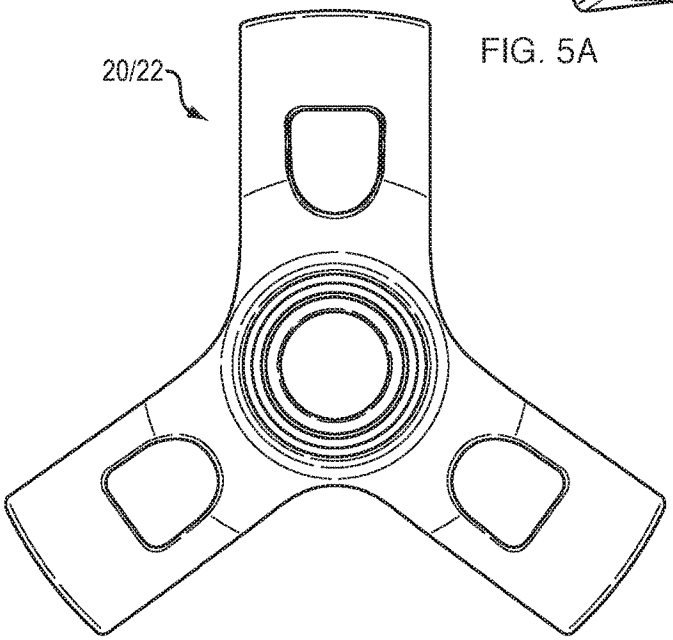
Figure 5D:
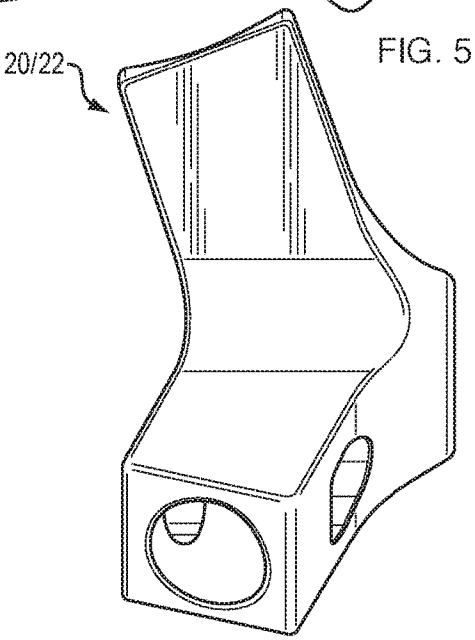
Figure 5E:
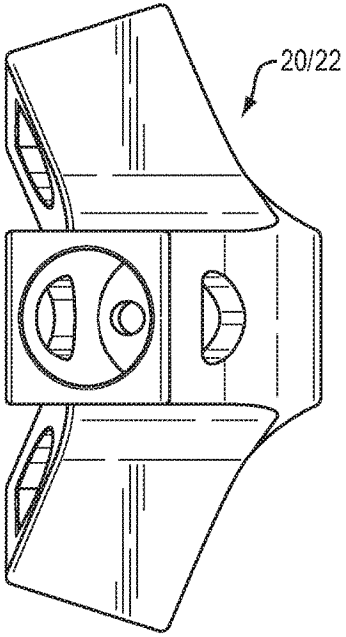

The leg segments 16*a*, 16*b* and 18*a*, 18*b* are arranged by the hubs 20, 22 at an angle 26 in FIG. 3 of between 45 and 90 degrees (preferably 32 degrees) from a vertical axis 30 when viewed from the front or back (as in FIG. 3), while each pair of leg segments 16*a*/16*b* and 18*a*/18*b* are also arranged at an angle 42 FIG. 4 vis-à-vis one another in the range of 0 to 90 degrees (preferably approximately 54 degrees) from the vertical axis 44 when viewed from the side. The chair support segments 16*c* and 18*c* are arranged and maintained at an angle 28 in FIG. 3 of between 0 and 45 degrees from the vertical axis 30 (preferably approximately 20 degrees).

In one embodiment, spacer segment 24 is arranged essentially level horizontally. In another embodiment, spacer segment 24 may be curved as shown by dashed line 24*a* in FIG. 3 so the height of the hub 20 can be increased and the crossbar segment 24 does not interfere with the bottom of the swinging seat 12.

It is contemplated that the swinging chair in accordance with the teachings of the present invention may be provided in 2 sizes. In the small size, the chair legs 16*a*/16*b* and 18*a*/18*b* have a length of approximately 11.4 inches while in the larger size, have a length of approximately 15 inches. The frame upright chair supports 16*c*/18*c* have a length of approximately 23.6 inches in the small size and 28 inches in the large size. In the small size, the crossbar segment 24 is approximately 18 inches in length while approximately 17 inches in length and the large size.

Figure 6B:
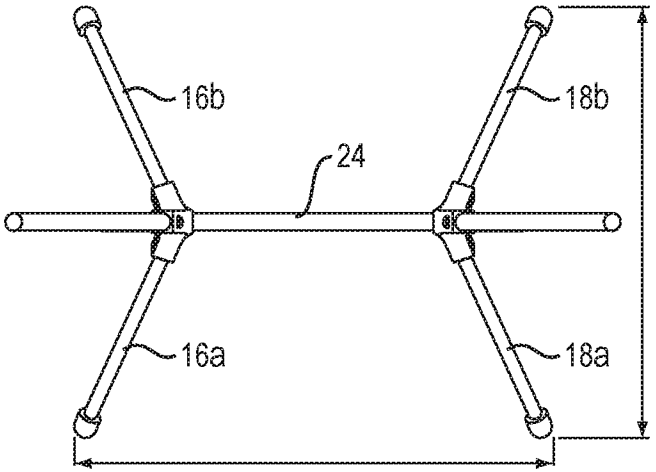
FIGS. 6A-6C are front, top and side perspective views of the swinging chair frame according to the invention.
Figure 6C:
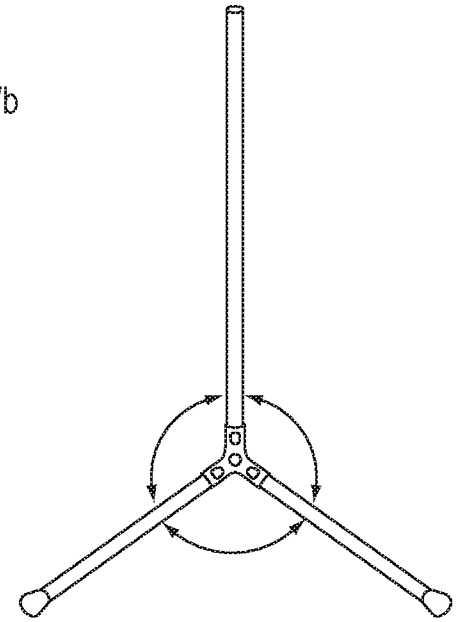
Figure 6A:
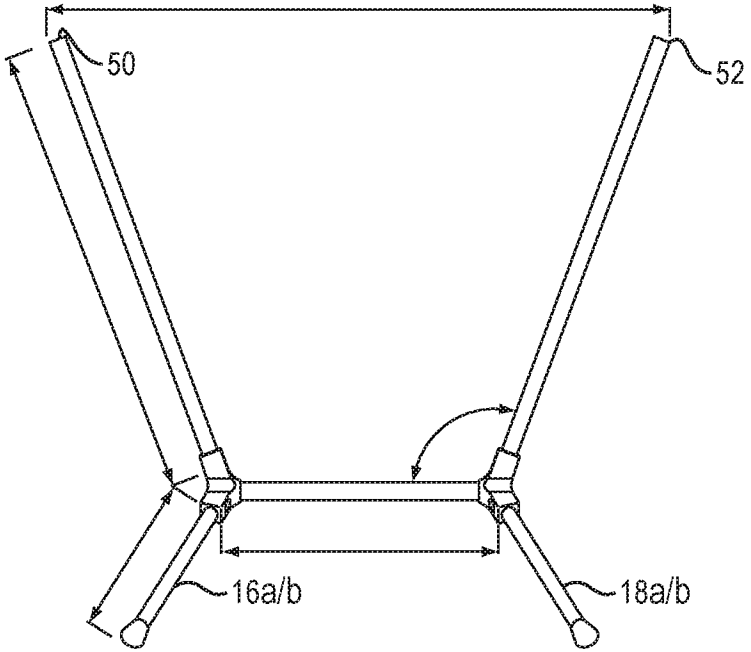

Chair components of the sizes (large and small) contemplated by the present invention provide a chair frame having approximately 34 inches of spacing for the small frame and 35.5 inches of spacing for the large frame between the 2 upright most portions of the frame 50 and 52 FIG. 6A; 26 inches between the bottoms of the chair frame feet where they contact the ground from a frontal perspective in the small size, FIG. 6B, and 28 inches between the bottoms of the chair frame feet in the large size.

Figure 8:
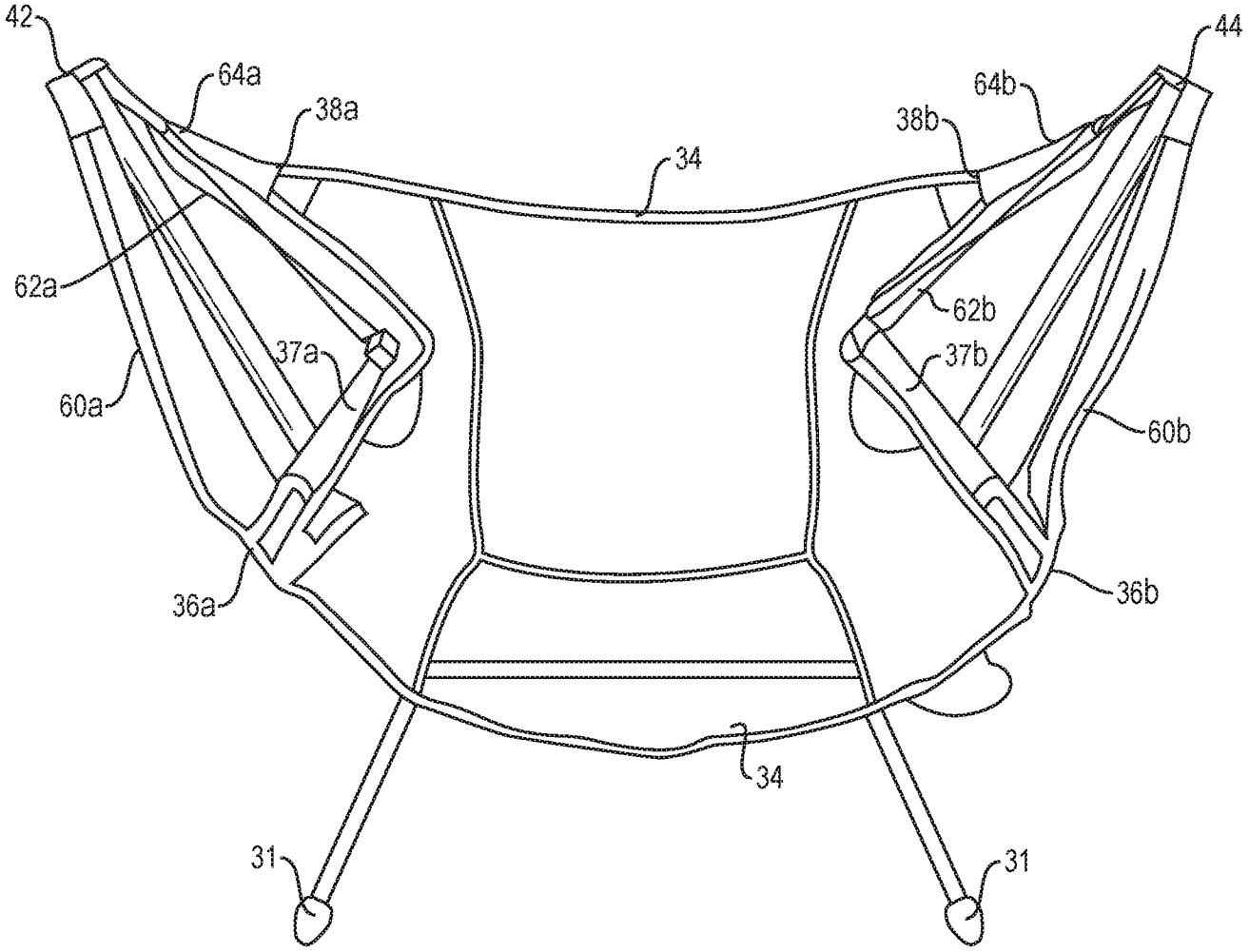
FIG. 8 is a perspective view of the swinging chair support and reclining system in accordance with one feature of the present invention.

The chair frame feet are preferably arranged approximately 19 inches apart at the base of the feet where they contact the ground from a side perspective for the small size, FIG. 6B, and 25 inches for the same components in the large size. The bottom portion of each of the legs 16*a*-16*b* and 18*a*-18*b* may include a nonslip foot 31 as shown in FIG. 8.

In one embodiment wherein the chair frame and or chair is packable or can collapse to make it more portable, the individual segments 16*a*-*c*, 18*a*-*c* and 24 are removed from the hubs 20, 22 and can be stored in a small bag or sleeve along with the hubs and potentially the chair seat for later assembly.

In another embodiment, the individual segments 16*a*-16*c* from one side of the frame 14, and segments 18*a*-18*c* from the other side of the frame 14 as well as spacer segment 24 may be held together by a standard shock cord run through the center of the segments as is well-known in the tent industry, in order to afford easy assembly and disassembly of the frame 14 and to prevent loss of the frame segments. In another embodiment of the present invention, the individual segments 16*a*-*c*, 18*a*-*c* and 24 could attach to hubs 20, 22 by hinging or swiveling elements, allowing the chair frame 14 to fold.

An additional feature of the preferred embodiment of the present invention includes reinforcement in strategic locations in one or more of the chair frame feet and upright segments. For example, in the leg segments 16*a* and 18*a* and 16*b* and 18*b*, FIG. 7A, approximately 4 inches (section 52) of that portion of the leg support that is inserted into the hub 20/22 may be reinforced with an additional piece of tubing 53 permanently located in the end region 52 where the leg segments enter the hub. Alternatively, the legs themselves may be made with a thicker wall thickness or diameter in the area of section 52 proximate the hub, tapering toward the feet 31 FIG. 8. These inserts and/or increased diameter or wall thickness in the legs help to strengthen the legs and help prevent their breakage or bending.

Figure 7B:
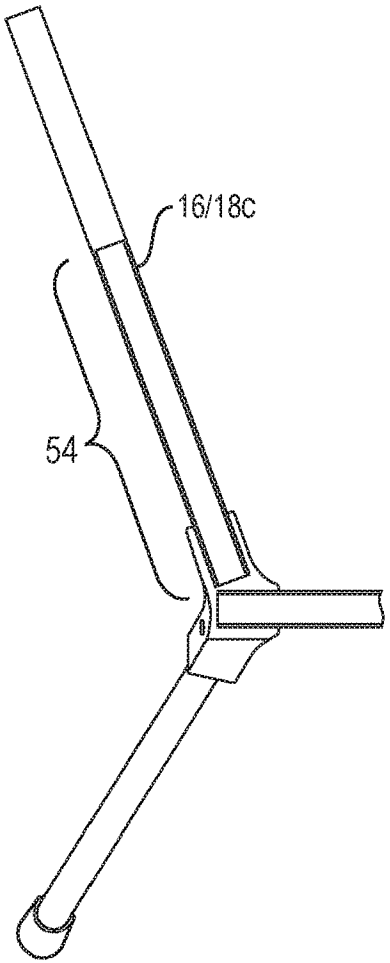
FIGS. 7A and 7B our close-up views of the legs and upright support of the swinging chair frame according to one embodiment of the present invention illustrating extra tube wall thickness in selected locations.
Figure 7A:
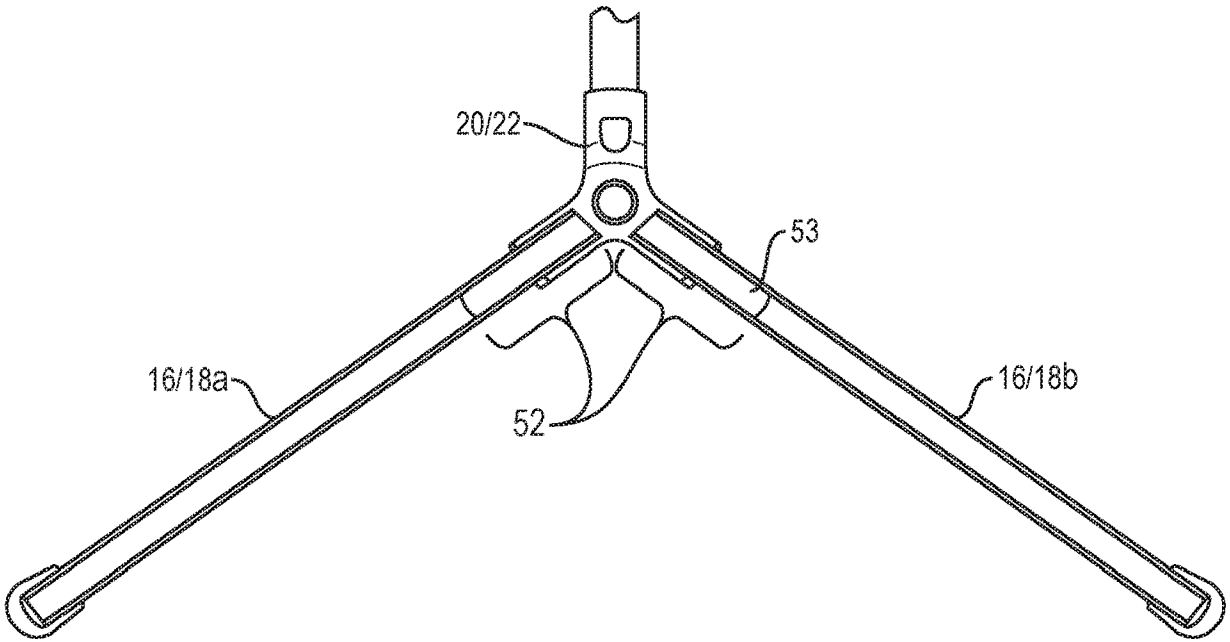

In somewhat similar fashion as shown in FIG. 7*b*, the upright supports 16*c*/18*c* may include a portion 54 having either an insert or an increased wall thickness to also help strengthen the uprights and help prevent breakage or bending. Use of these reinforcements may allow the use of lighter weight materials for the rest of the frame and a reduction of overall weight of the chair frame 14.

The swinging seat portion 12, FIGS. 1 and 8, may, in one embodiment, be made of a more rigid, non-pliable, non-collapsible material such as wood, plastic or composite material. In another embodiment, the swinging chair portion 12 may be made of a pliable, durable material such as woven or knit fabric, mesh or leather. The swinging seat portion 12 comprises a seat bottom region 32, and a seat back portion 34. Three nylon or similar straps or cordage 60, 62 and 64 are provided on each side of the swinging seat and serve to support and suspend the seat for the user.

One strap 60*a/b*, preferably of fixed length, is attached proximate each front corner portion 36*a/b* of each side of the seat bottom portion 32 to a front portion of each armrest 37; one strap 64 *a/b* is attached proximate each of the top corner regions 38 *a/b* of the seat back portion 34; while one set of straps 62 *a/b* is attached part-way down the seat back portion 34 to a rear portion of each armrest 37. The swinging seat portion 12 may also have built-in armrests 37 made of a rigid or semi-rigid structure enclosed in seat material.

Figure 10A:
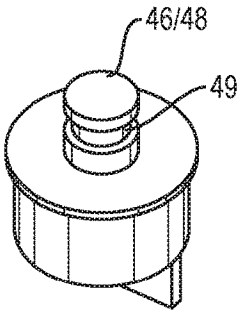
FIGS. 10A-10B are close-up perspective views of the locking upright pole tip according to one feature of the present invention.
Figure 10B:
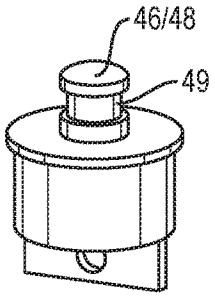
Figure 9B:
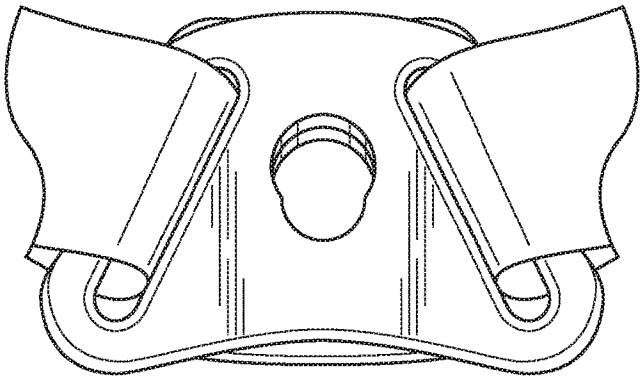
FIGS. 9A and 9B is a top view of the chair reclining mechanism strap lock according to one feature of the present invention.
Figure 9A:
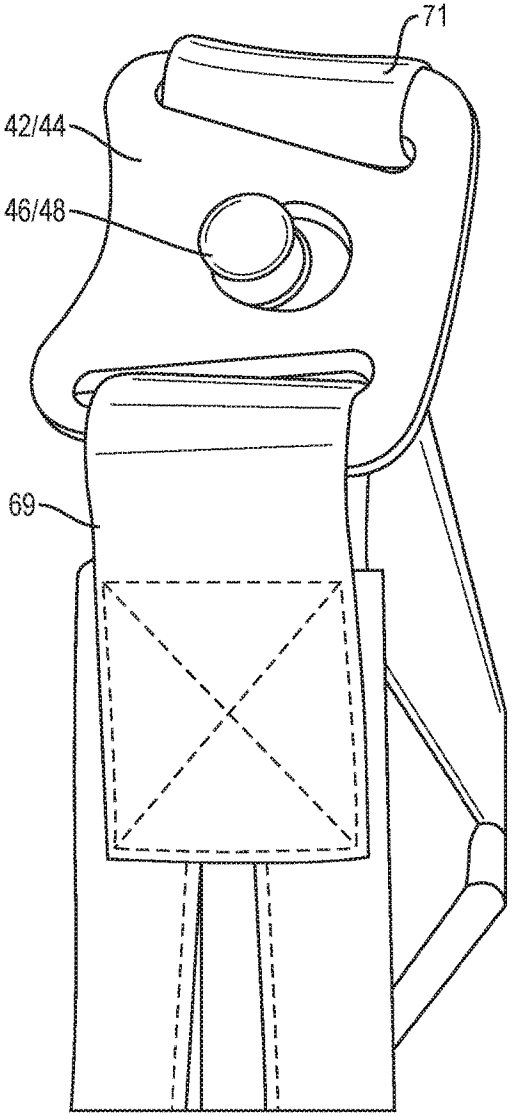

In one embodiment, the straps 60, 62 and 64 (three from each side) come together at a metal locking plate system 42, 44 FIG. 9 (as will be explained in greater detail below) that have a hole and/or slot in the center of the metal locking plates. In this embodiment, there is a relatively short knob or protrusion 46, 48 FIGS. 9 and 10 at the top of each of the chair supports 16*c* and 18*c* over which the metal locking plate systems 42, 44 are placed, to support the swinging seat portion 12.

Figure 11A:
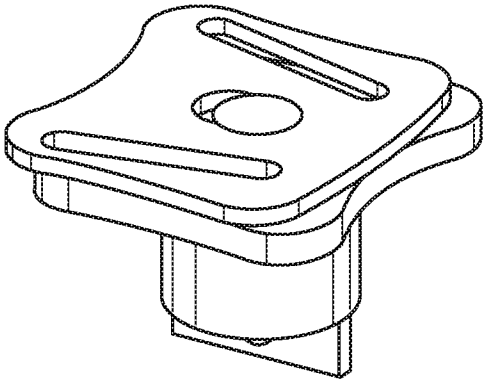
FIG. 11A-11K close-up perspective views of two embodiments of the chair reclining mechanism strap lock according to one feature of the present invention.
Figure 11B:
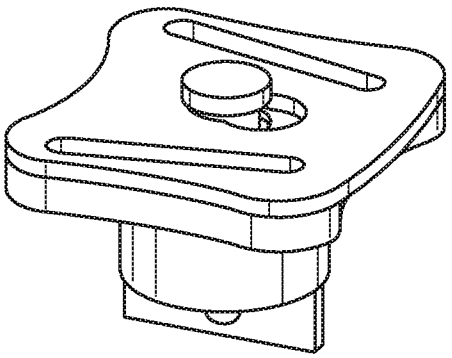
Figure 11C:
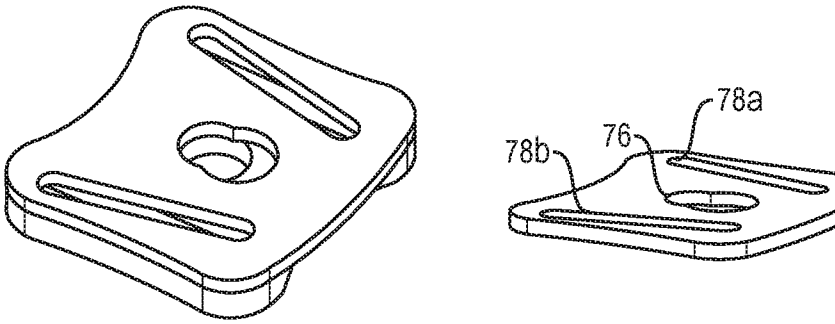
Figure 11D:
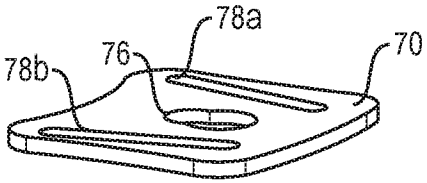
Figure 11E:
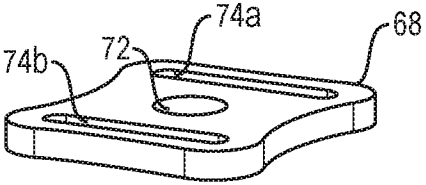
Figure 11H:
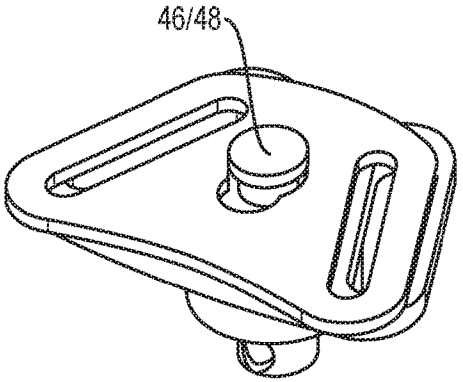
Figure 11K:
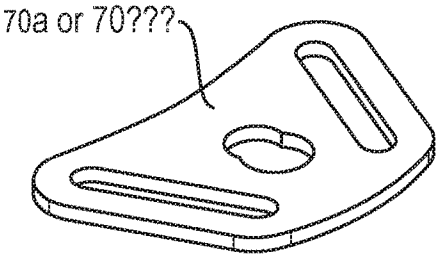
Figure 11G:
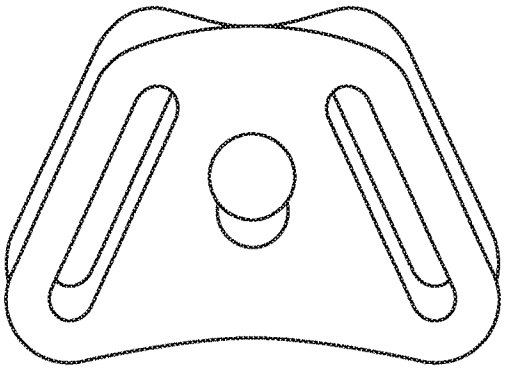
Figure 11J:
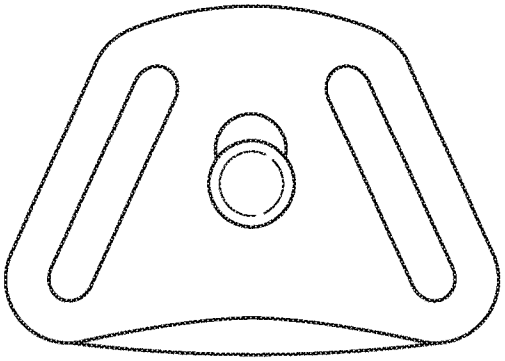

The metal locking plate system 42/44 is designed to lock the seat 12 into the frame 14 without using complex mechanisms, while ensuring that the user's weight prevents it from becoming unlocked during use. The metal locking plate system 42/44 is made up of 3 components: a locking pole tip 46/48 with an undercut 49 which are part of the frame 14; and two metal plates 68, 70 which are attached to the seat straps 69/71. The bottom metal plate 68 has a hole 72 for the pole tip 46/48 to fit through and, in one embodiment shown in FIG. 11E two parallel slots 74 *a/b* for webbing from the support straps 69/71 to weave through.

Figure 11F:
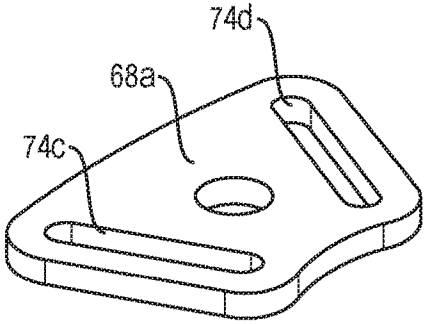
Figure 11I:
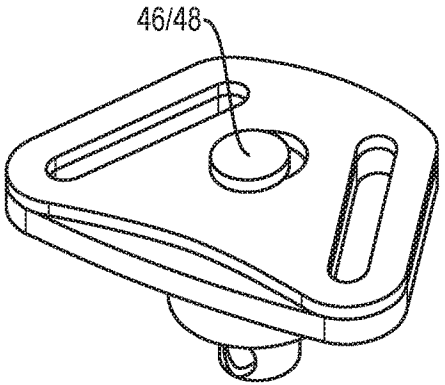

In another embodiment shown in FIG. 11F, slots 70 4C and 70 4D may be at an angle vis-à-vis one another in a similar angle as shown in the slots in the top plate 70*a*. The top plate 70 has a keyhole 76 which is a cut out in the shape of 2 staggered circles of different diameters, as well as webbing slots 78 that are at an angle to each other. The plates 68 and 70 which make up the metal locking plate system 42, 44 can slide relative to each other to allow different alignments between the keyhole 76 and the hole 72 in the bottom plate.

To install the metal locking plate system 42, 44 on the pole tip 46/48, the top plate 70 must slide over and align the larger portion of the keyhole 76 with the bottom plate's hole 72. After installation, the top plate 70 will slide back over with the keyhole fitting into the undercut 49 of the pole tip 46/48.

When the chair is weighted and the webbing tensioned, it is unreasonably difficult to align the plates for seat removal ensuring that the user's weight maintains the swinging chair 12 securely on the frame 14.

The straps 60, 62 and 64 are automatically adjustable to allow the user to adjust the swinging angle he or she is seated at as well as the angle between the back of the chair 34 and the bottom 32 allowing a user to adjust the chair 12 to provide nearly upright seating or a reclined lounge seating.

In another embodiment, the frame 14 may be provided without a protrusion for connecting to the metal locking plate system 42, 44. Instead, the seat 12 may include a reinforced "pocket" which slides over the top of the uprights 16*c*, 18*c*, to secure the chair seat 12 to the frame 14. In another embodiment, the seat 12 could have a short post or plug that inserts into a hollow and of the uprights 16*c*, 18*c*.

Figure 12:
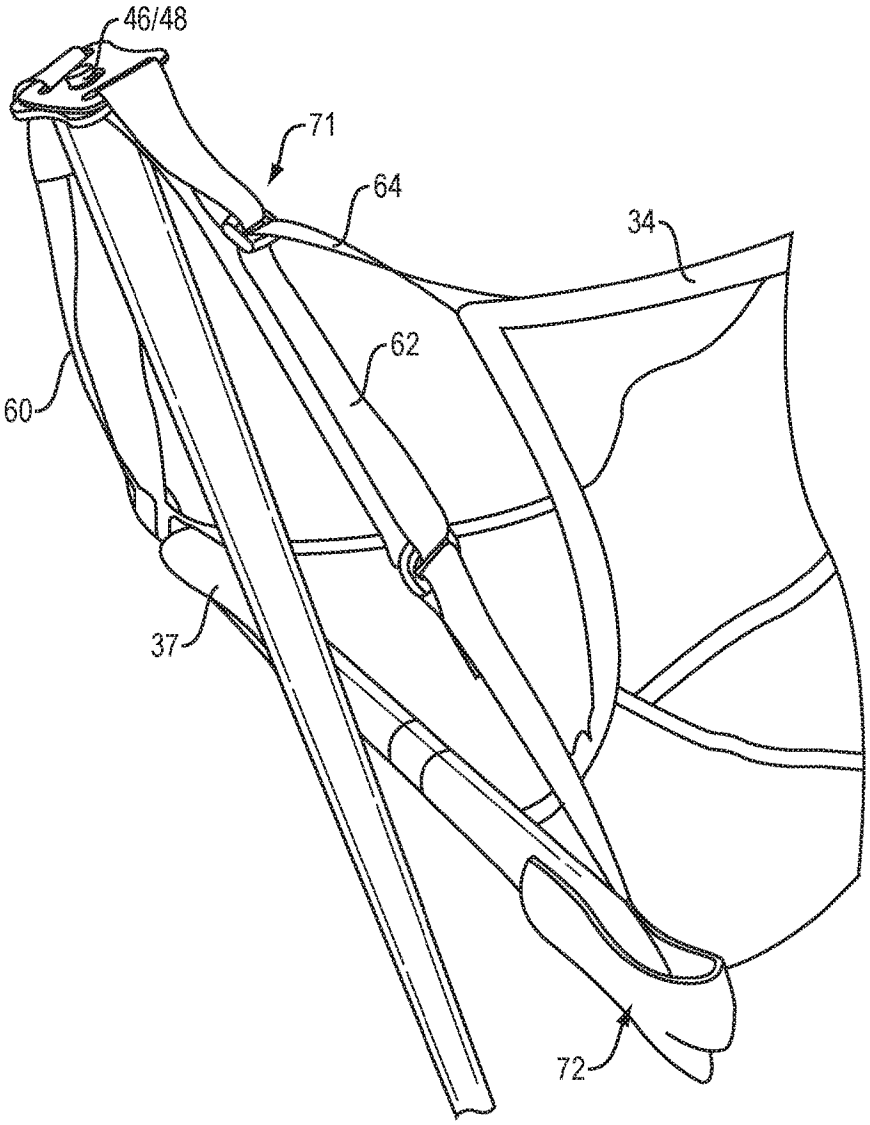
FIG. 12 is a view of one side of the auto reclining mechanism of the swinging chair according to the present invention.

In one embodiment, the back portion 34 of the chair 12 is attached by a 2:1 pulley system 71, FIG. 12, on each side of the chair, which pulley system connects to the swinging points 46/48 of the swinging chair and back down to the back portion 72 of the armrests 37. The pulley system 71 is balancing the user's weight to the pressure they are applying to the backrest 34 with a 2:1 advantage for the backrest. A person sitting down in the chair can push back against the backrest 34 to recline. When the user sits up, the user's weight automatically brings the backrest back up behind them. Accordingly, the novel pulley system 71 of the present invention provides an auto-reclining feature to the chair of the present invention without utilizing springs, elastics, weights or other mechanisms to activate reclining of the back portion of the chair 34.

Figure 13:
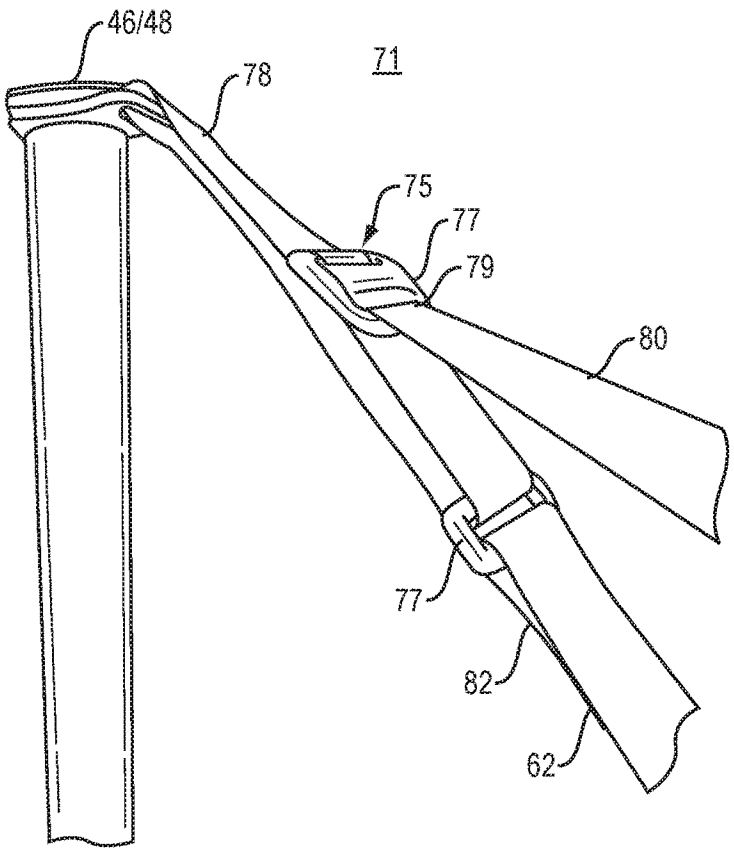
FIG. 13 is a close-up view of the auto reclining mechanism pulley system of the swinging chair according to one embodiment of the present invention.

As shown in greater detail in FIG. 13, the pulley system 71 in accordance with one feature of the present invention includes a topmost pulley 75 and a bottom pulley 77. The topmost pulley 75 is commonly known or referred to as a strap adjuster or a triglide and may be made of metal or plastic, as appropriate and required. The second or bottom most pulley 77 is commonly known or referred to as a strap loop and may also be made of metal or plastic, or composite as appropriate and required.

Figure 15:
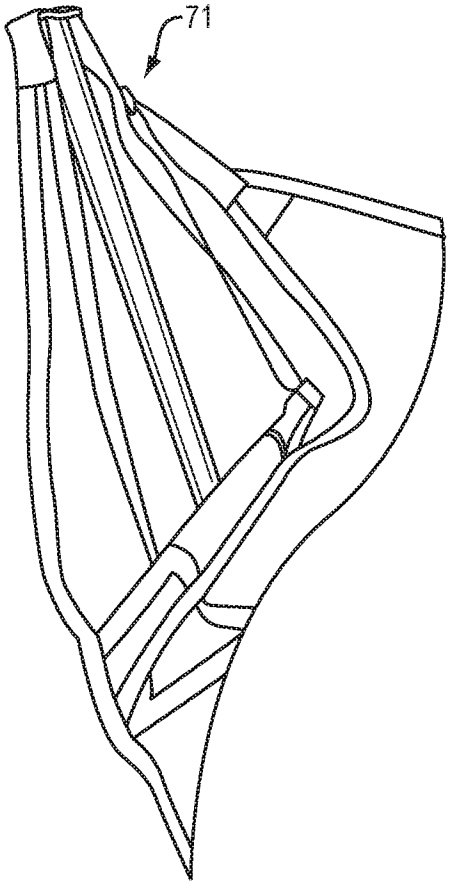
FIG. 15 is a side view of the auto reclining system and attachment to the armrest and the back rest of the swinging chair according to the present invention.
Figure 14:
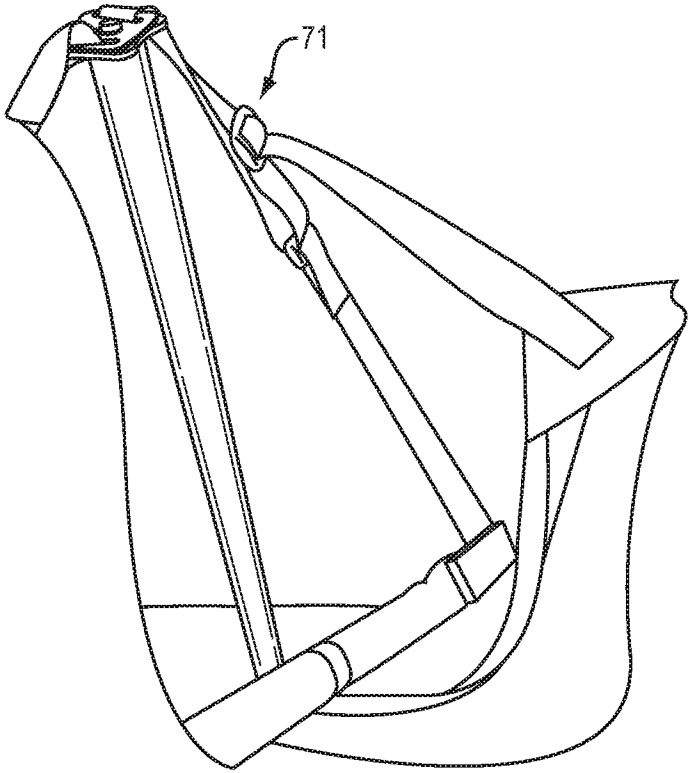
FIG. 14 is a perspective view of the reclining mechanism and pulley system of the auto reclining system of the present invention.

The topmost pulley 75 includes a central region 77 to which is permanently fastened a first portion of strap 78 approximately 2.25 inches long which anchors the top pulley 75 a fixed distance from the frame anchor point 46/48. A second region 79 of the top pulley 75 provides a region through which a portion of strap 80 attached at one end to the frame anchor point 46, 48 of the respective side of the chair. Strap portion 80 begins from the frame anchor point 46/48, threads downward through the bottom pulley 77; upward through the second region 79 of the top pulley 75 and then subsequently attaches to the sides of the backrest 34 forming strap portion 64 previously described in connection with FIG. 12. The bottom pulley 77 is fixed by strap 82 to the rear of the arm rest 37 forming strap portion 62 previously described. The dashed lines show the path of the strap 80 through the top and bottom pulleys 75/77. Additional perspective views of the pulley system 71 are shown in FIGS. 14 and 15.

Figure 16B:
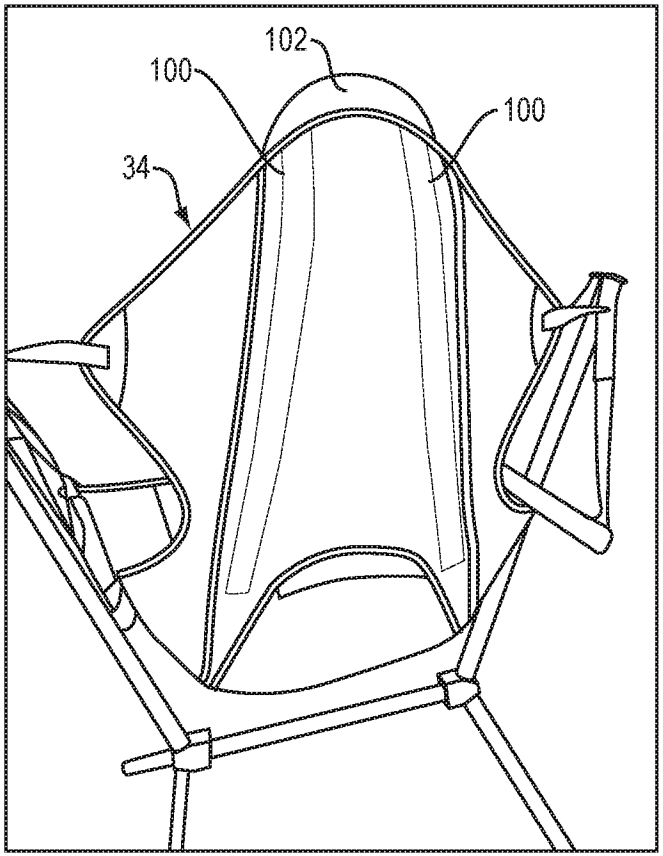
FIGS. 16A and 16B are front and rear views respectively of one embodiment of the back rest and headrest support system according to one feature of the present invention.
Figure 16A:
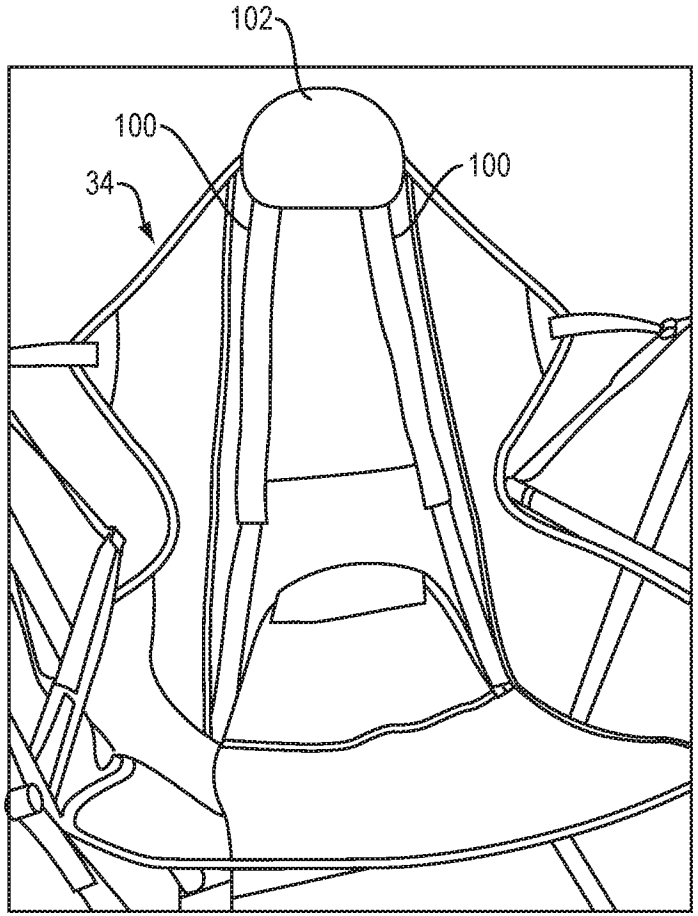

In another embodiment of the present invention, a deployable, foam padded headrest along with one or more headrest and chair back support elements may be provided. In one embodiment shown in FIGS. 16A and 16B, the backrest 34 may be provided with several flat aluminum bars 100 which serve to keep the shape of the back element upright and support a headrest 102.

Figure 17B:
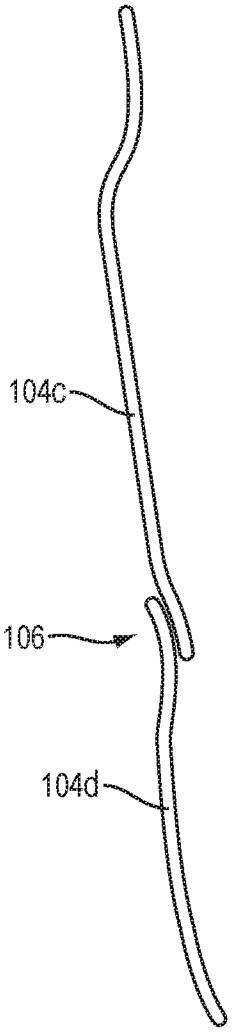
FIG. 17. is a side view of the back rest and headrest support according to one embodiment of the present invention.
Figure 17A:
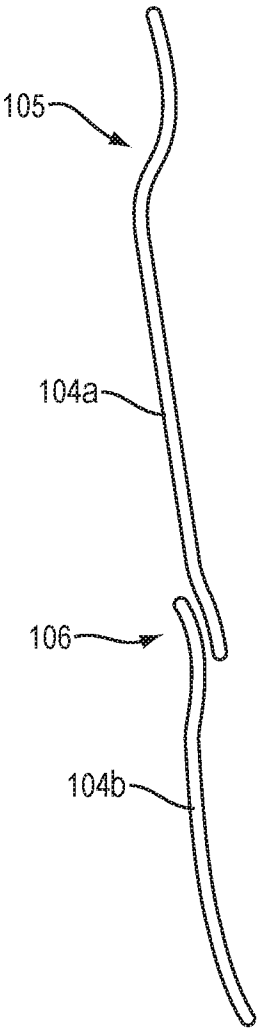
Figure 18A:
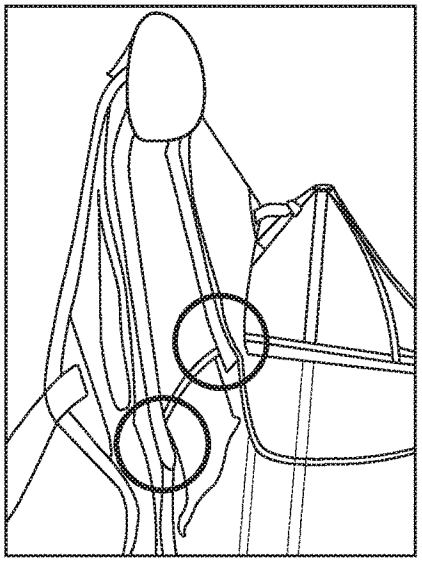
FIGS. 18A-18E are perspective views of the swinging chair according to the present invention utilizing flat bars to support the headrest and back portion of the chair seat.
Figure 18B:
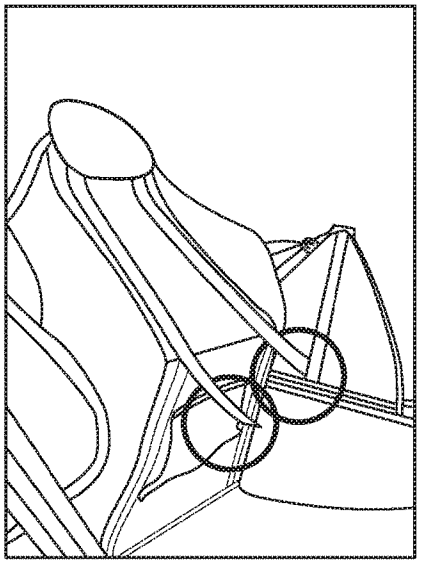
Figure 18C:
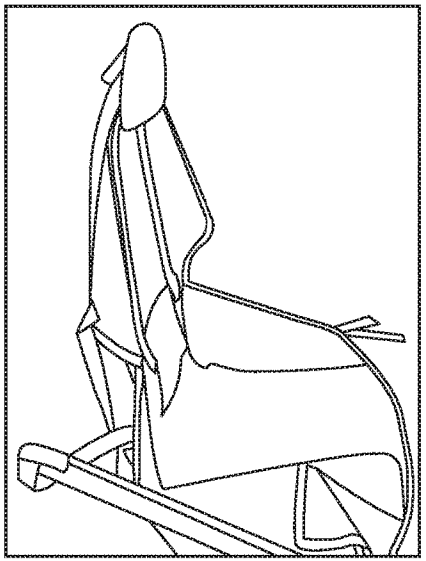
Figure 18D:
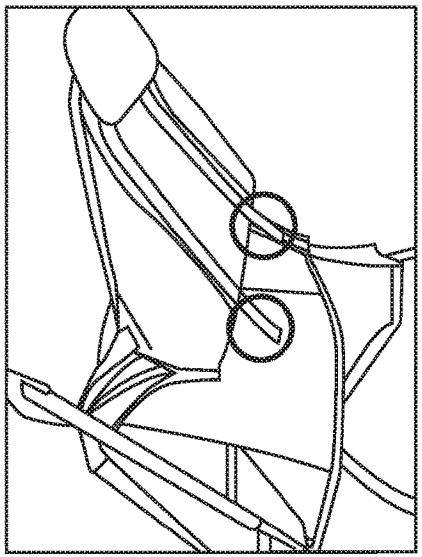
Figure 18E:
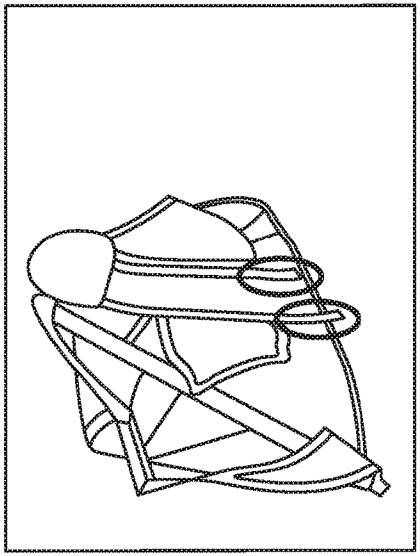

In the preferred embodiment, four flat aluminum bars 104, FIG. 17 may be provided. In this embodiment, the aluminum bars may have pre-bends 105, 106 in them to generally match the shape of the user's back. The aluminum bars 104 provide lumbar support and support for the headrest 102.

In this embodiment, the top bars 104*a* and 104*c* are approximately 21 inches in length and the bottom bars 104*b* and 104*d* approximately 14 inches in length. The top and bottom bars overlap in a central region 106 and may be provided with a bend or custom bent by the user to achieve a comfortable fit in the area of the chair back 34. The top bars 104*a* and 104*c* are sewn into the seat except where they overlap with the lower bars enabling the top bars to pop off the lower bars to enabling folding of the seat back 34, FIG. 18.

Figure 19:
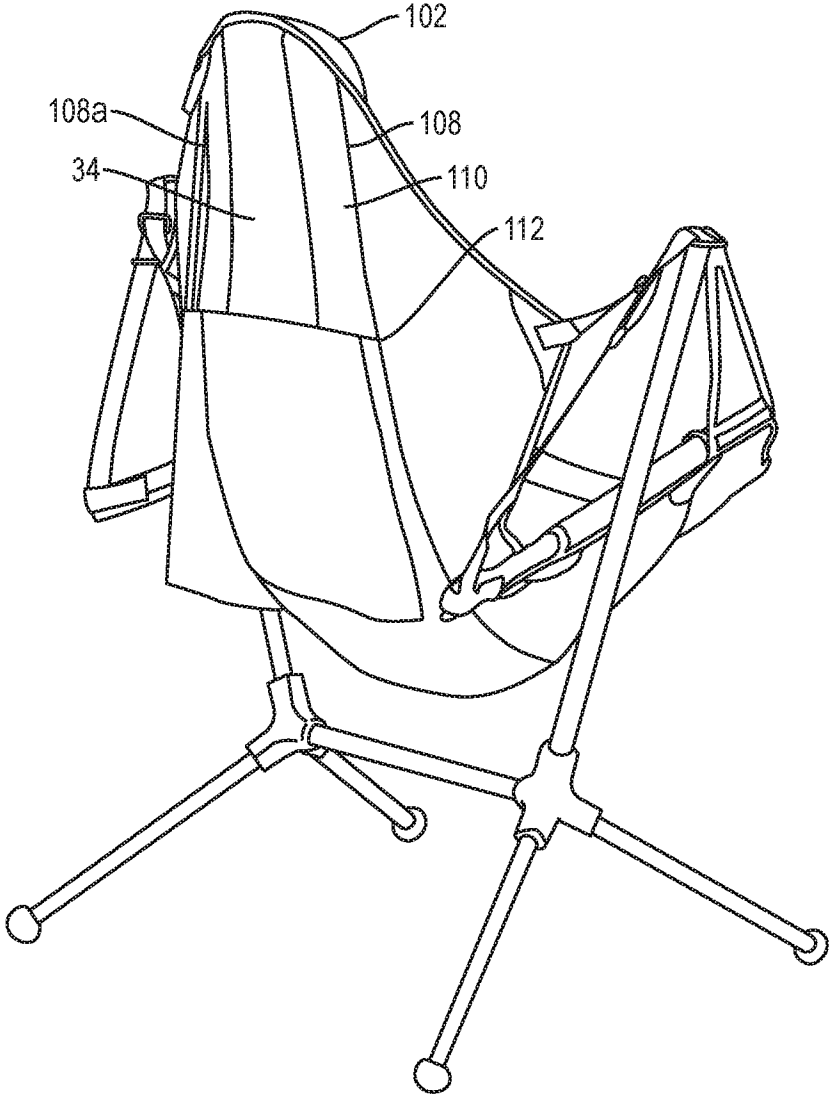
FIG. 19 is a perspective view of the swinging chair according to the present invention utilizing poles to support the headrest and back portion of the chair seat.
Figure 20B:
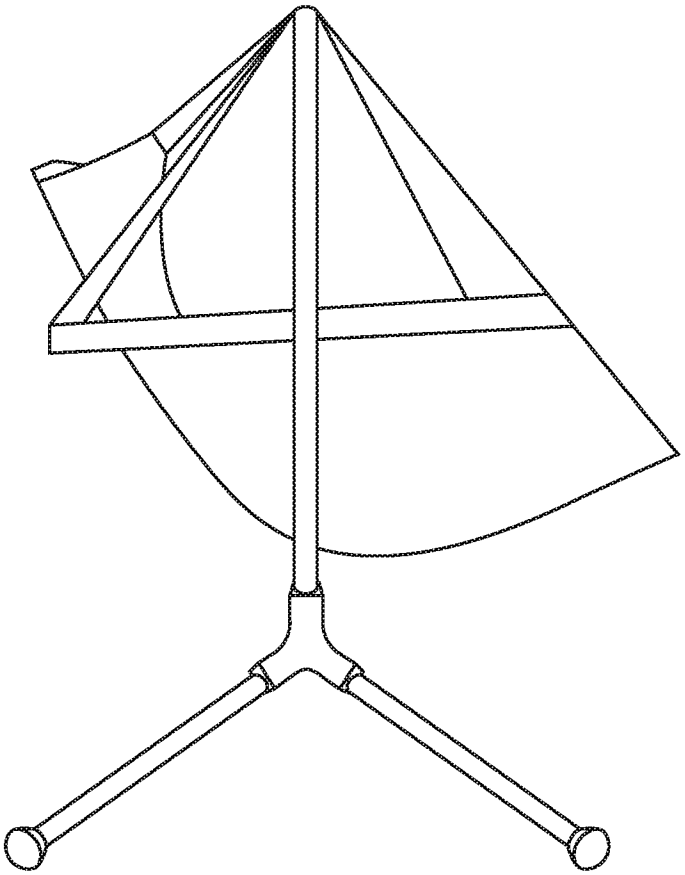
FIGS. 20A, 20B, 21A and 21B are perspective front and side views of high back and low back versions of the hanging chair in accordance with the present invention.
Figure 20A:
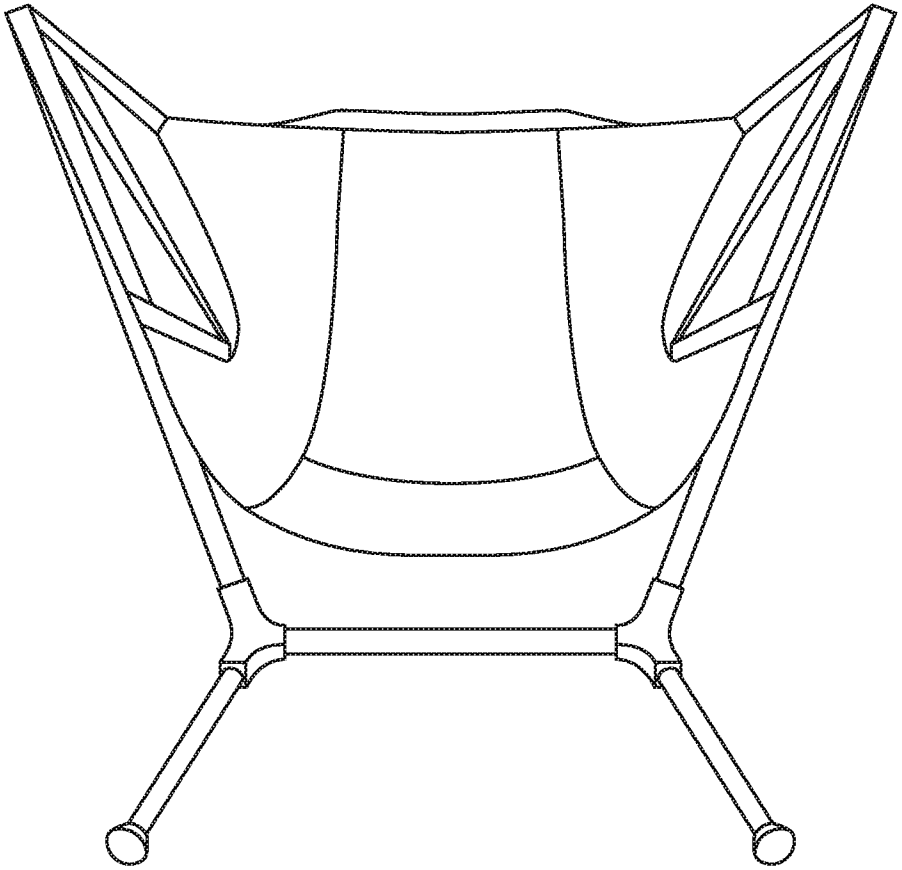
Figure 21B:
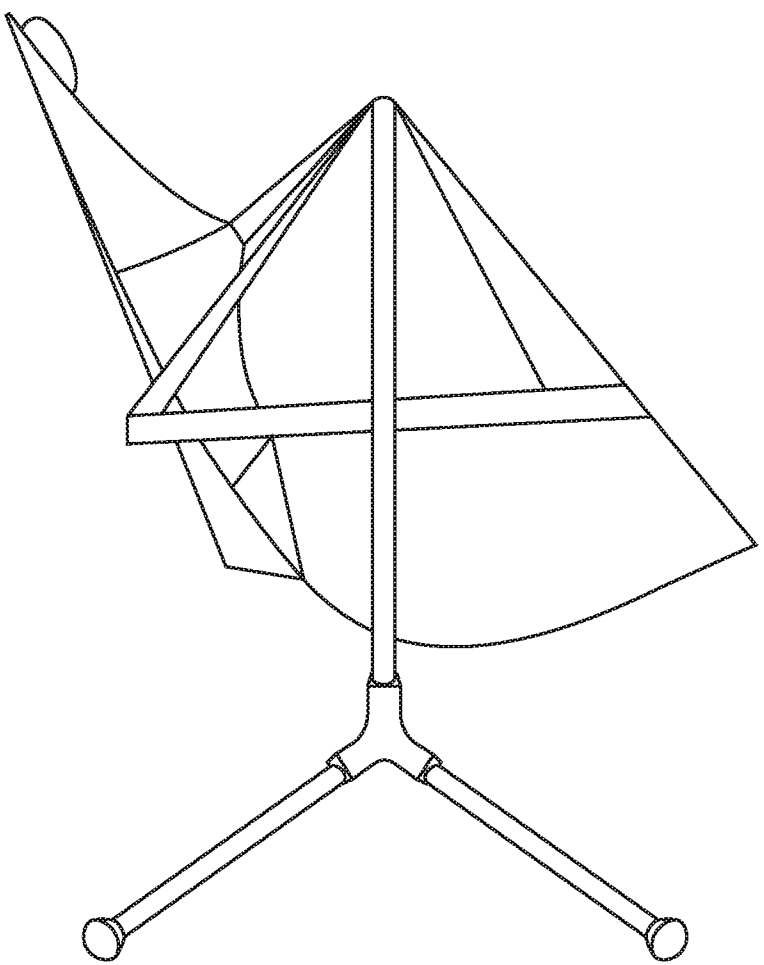
Figure 21A:
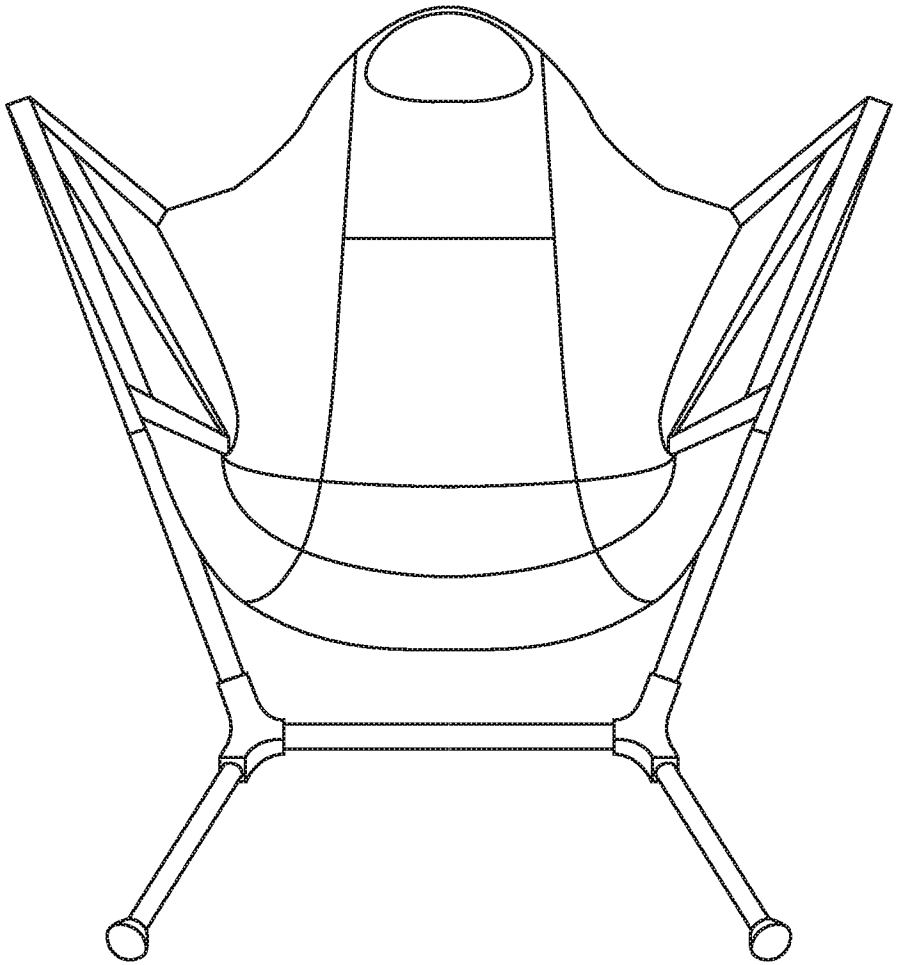

In the preferred embodiment of the swinging chair with headrest and back support according to the present invention, a complete backrest 34 and headrest 102, FIG. 19 may be provided utilizing two poles 108 and 108*a*. The two poles 108 are similar in style to tent poles running up the length of the backrest 34 to fully support the headrest 102. The poles 108 may be in one piece or preferably, each pole is in 2 segments of similar length connected by a shock cord, to allow them to disassemble for packing. The lower half of each poll 108 is fully inserted into a sleeve where it can stay when packed. The topmost tip of each upper half of each poll 108 is inserted into a small pocket near the headrest 102 to keep it located and securely attached to the headrest. The poles are tent style poles connected together with a shock cord allowing them to be folded for disassembly and storage yet stay connected together so as not to be lost. The top portion of the seat back or backrest 34 may include padding 110 to add additional support and stability to the back of the chair. The bottom portion 112 of the padded area aligns generally with the location of the poles segments which facilitates folding of the backrest for storage and packing. In one embodiment, the headrest 102 may be a pillow type device to provide more comfort and support for the user, as needed. The headrest 102 may be attached with hook and loop fasteners to the seat back 34 so it can be relocated, removed and/or adjusted as needed or desired by the user.

Accordingly, the present invention provides a novel, lightweight and portable, auto-reclining swinging chair frame and seat that can be easily packed and carried for use in outdoor or indoor settings.

Modifications and substitutions by one of ordinary skill in the art are considered to be within the scope of the present invention, which is not to be limited except by the allowed claims and their legal equivalents.

The invention claimed is:

1. A swinging chair, said swinging chair comprising:

a frame; and a chair seat suspended within said frame and configured for swinging within said frame, said chair seat constructed if a lightweight, pliable material and including a chair seat bottom having a front portion and a rear portion and a chair seat back having a top portion and a bottom portion, wherein said rear portion of said chair seat bottom is coupled to said bottom portion of said chair seat back;

said frame comprising:

first and second chair seat support structures, each of said first and second chair seat support structures including two chair support legs and one chair support upright, said two chair support legs and one chair support upright of each of said first and second chair seat support structures coupled together by means of a hub;

a chair support structure cross-bar, configured for attaching between said first and second hubs of said first and second chair seat support structures, for maintaining said first and second hubs in a predetermined spaced relationship; and a chair seat support mechanism, said chair seat support mechanism comprising a plurality of chair seat front and back flexible support straps, said plurality of chair seat front and back flexible support straps comprising:

first and second chair seat front support strap members, said first chair seat front support strap member coupled directly to a first side of said lightweight and pliable chair seat bottom front portion between said first side of said chair seat bottom front portion and a first one of said chair support uprights, and said second chair seat front support strap member coupled directly to a second side of said lightweight and pliable chair seat bottom front portion between said second side of said chair seat bottom front portion and a second one of said chair support uprights; and first and second chair seat back support strap members, said first chair seat back support strap member coupled directly to a first side of said lightweight and pliable chair seat back top portion between said first side of said chair seat back top portion and said first one of said chair support uprights, and said second seat back support strap member coupled directly to a second side of said lightweight and pliable chair seat back top portion between said second side of said chair seat back top portion and said second one of said chair support uprights.

2. The swinging chair according to claim 1, wherein said first and second front chair seat support strap members and said first and second chair seat back support strap members are made of a flexible and pliable material.

3. The swinging chair according to claim 2, wherein said first front chair seat support strap member and said first chair seat back support strap member are coupled together, and wherein said second front chair seat support strap member and said second chair seat back support strap member are coupled together.

4. The swinging chair according to claim 3, wherein one end of said first front chair seat support strap member and said first chair seat back support strap member are coupled together in a first coupling region, and wherein said first coupling region forms a pocket configured for being inserted over a topmost region of a first one of said chair support uprights, and wherein one end of said second front chair seat support strap member and said second chair seat back support strap member are coupled together in a second coupling region and wherein said second coupling region forms a pocket configured for being inserted over a topmost region of a second one of said chair support upright.

5. The swinging chair according to claim 2, wherein said chair support uprights of each of said first and second chair seat support structures include a protrusion on an uppermost end of each of said chair support uprights.

6. The swinging chair according to claim 5, wherein said first front chair seat support strap member and said first chair seat back support strap member are coupled together in a first coupling region by a first metal coupling member, and wherein said first metal coupling member includes an opening configured for being inserted over said protrusion on an uppermost end of a first one of said chair support uprights, and wherein said second front chair seat support strap member and said second chair seat back support strap member are coupled together in a second coupling region by a second metal coupling member, and wherein said second metal coupling member includes an opening configured for being inserted over said protrusion on an uppermost end of a second one of said chair support uprights.

7. The swinging chair according to claim 6, wherein said first chair seat back support strap member comprises first and second flexible seat back support strap elements, said first flexible seat back support strap element of said first chair seat back strap support member coupled proximate a first end directly to a top portion of a first side of said lightweight and pliable chair seat back, and said second flexible chair seat back support strap element of said first chair seat back support strap member coupled proximate a first end directly to a bottom portion of said lightweight and pliable chair seat back, and wherein a second end of said first flexible chair seat back support strap element and said second flexible chair seat back support strap element of said first seat back support member are coupled to said first metal coupling member, and wherein said second chair seat back support strap member comprises first and second flexible chair seat back support strap elements, said first flexible chair seat back support strap element of said second chair seat back support strap member coupled proximate a first end directly to a top portion of a second side of said lightweight and pliable chair seat back, and said second flexible chair seat back support element of said second chair seat back support strap member coupled proximate a first end directly to a bottom portion of said lightweight and pliable chair seat back, and wherein a second end of said first flexible chair seat back support strap element and said second flexible chair seat back support strap element of said second chair seat back support strap member are coupled to said second metal coupling member, and wherein said first and second metal coupling members allow said first and second flexible chair seat back support strap elements of each of said first and second chair seat back support strap members to be adjusted relative to one another causing an angle of the seat back to be adjusted vis-à-vis the lightweight and pliable chair seat bottom.

8. The swinging chair of claim 7, wherein said second flexible chair seat back support strap element of said first chair seat back support strap member is coupled proximate said first end to a first end of a first arm rest coupled to said bottom portion of said chair seat back, and wherein said second flexible chair seat back support strap element of said second chair seat back support strap member is coupled proximate said first end to a first end of a second armrest to said bottom portion of said chair seat back, and wherein a first end of said first front chair seat support strap member is coupled to a second end of said first armrest and wherein a first end of said second front chair seat support strap member is coupled to a second end of said second armrest.

9. A swinging chair, said swinging chair comprising:

a frame; and a chair seat suspended within said frame and configured for swinging within said frame, said chair seat constructed of a lightweight, pliable material and including a chair seat bottom having a front portion and a rear portion and a chair seat back having a top portion and a bottom portion, wherein said rear portion of said chair seat bottom is coupled to said bottom portion of said chair seat back;

said frame comprising:

first and second chair seat support structures, each of said first and second chair seat support structures including two chair support legs coupled to a chair support upright, said first and second chair seat support structures coupled together by means of a one or more cross-members, said one or more cross-members configured for attaching between said first and second chair seat support structures, for maintaining said first and second chair seat support structures in a predetermined spaced relationship; and a chair seat support mechanism, said chair seat support mechanism comprising a plurality of chair seat front and back flexible support straps, said plurality of chair seat front and back flexible support straps comprising:

first and second chair seat front support strap members, said first chair seat front support strap member coupled directly to a first side of said lightweight and pliable chair seat bottom front portion between said first side of said lightweight and pliable chair seat bottom front portion and a first one of said chair support uprights, and said second chair seat front support strap member coupled directly to a second side of said lightweight and pliable chair seat bottom front portion between said second side of said lightweight and pliable chair seat bottom front portion and a second one of said chair support uprights; and first and second chair seat back support strap members, said first chair seat back support strap member coupled directly to a first side of said lightweight and pliable chair seat back top portion between said first side of said lightweight and pliable chair seat back top portion and said first one of said chair support uprights, and said second chair seat back support strap member coupled directly to a second side of said lightweight and pliable chair seat back top portion between said second side of said lightweight and pliable chair seat back top portion and said second one of said chair support uprights.

10. A swinging chair, said swinging chair comprising:

a frame; and a chair seat, suspended within said frame and configured for swinging within said frame, said chair seat constructed of a lightweight, pliable material and including a chair seat bottom having a front portion and a rear portion and a chair seat back having a top portion and a bottom portion, wherein said rear portion of said chair seat bottom is coupled to said bottom portion of said chair seat back;

said frame comprising:

first and second chair seat support structures, each of said first and second chair seat support structures including two chair support legs coupled to a chair support upright, said first and second chair seat support structures coupled together by means of a one or more cross-members, said one or more cross-members configured for attaching between said first and second chair seat support structures, for maintaining said first and second chair seat support structures in a predetermined spaced relationship; and a chair seat support mechanism, said chair seat support mechanism comprising a plurality of chair seat front, rear and back flexible support straps, said plurality of chair seat front, rear and back flexible support straps comprising:

first and second chair seat front support strap members, said first chair seat front support strap member coupled directly to a first side of said lightweight and pliable chair seat bottom front portion between said first side of said lightweight and pliable chair seat bottom front portion and a first one of said chair support uprights, and said second chair seat front support strap member coupled directly to a second side of said lightweight and pliable chair seat bottom front portion between said second side of said lightweight and pliable chair seat bottom front portion and a second one of said chair support uprights;

first and second chair seat rear support strap members, said first chair seat rear support strap member coupled directly to a first side of said lightweight and pliable chair seat bottom portion between said first side of said lightweight and pliable chair seat bottom portion and said first one of said chair support uprights, and said second chair seat rear support strap member coupled directly to second side of said lightweight and pliable chair seat bottom rear portion between said second side of said lightweight and pliable chair seat bottom rear portion and said second one of said chair support uprights; and first and second chair seat back support strap members, said first chair seat back support strap member coupled directly to a first side of said lightweight and pliable chair seat back top portion between said first side of said lightweight and pliable chair seat back top portion and said first one of said chair support uprights, and said second chair seat back support strap member coupled directly to a second side of said lightweight and pliable chair seat back top portion between said second side of said lightweight and pliable chair seat back top portion and said second one of said chair support uprights.

11. The swinging chair according to claim 10, wherein said chair seat comprises a flexible and pliable chair seat.

12. The swinging chair according to claim 10, wherein each of said chair support uprights are configured as two segments coupled together by an elastic cord member.

13. The swinging chair of claim 11, wherein said chair seat back includes first and second vertically oriented support elements, configured for maintaining said chair seat back in a generally vertical and upright position.

14. The swinging chair of claim 13, wherein said first and second vertically oriented support elements each comprise one vertically oriented support element.

15. The swinging chair of claim 13, further including a pillow structure removably coupled proximate a top region of said chair seat back.

16. The swinging chair of claim 13, wherein said first and second vertically oriented support elements each comprise first and second vertically oriented support element segments.

17. The swinging chair of claim 16, wherein said first and second vertically oriented support element segments of each of said first and second vertically oriented support elements are coupled together by an elastic cord.

18. A swinging chair, said swinging chair comprising:

a frame; and a chair seat suspended within said frame and configured for swinging within said frame, said chair seat including a chair seat bottom having a front portion and a rear portion and a chair seat back having a top portion and a bottom portion, wherein said rear portion of said chair seat bottom is coupled to said bottom portion of said chair seat back;

said frame comprising:

first and second chair seat support structures, each of said first and second chair seat support structures including two chair support legs and one chair support upright, said two chair support legs and one chair support upright of each of said first and second chair seat support structures coupled together by means of a hub;

a chair support structure cross-bar, configured for attaching between said first and second hubs of said first and second chair seat support structures, for maintaining said first and second hubs in a predetermined spaced relationship; and a chair seat support mechanism, said chair seat support mechanism comprising a plurality of chair seat front and back flexible support straps, said plurality of chair seat front and back flexible support straps comprising:

first and second chair seat front support strap members, said first chair seat front support strap member coupled between a first side of said chair seat bottom front portion and a first one of said chair support uprights, and said second chair seat front support strap member coupled between a second side of said chair seat bottom front portion and a second one of said chair support uprights; and first and second chair seat back support strap members, said first chair seat back support strap member coupled between a first side of said chair seat back top portion and said first one of said chair support uprights, and said second chair seat back support strap member coupled between a second side of said chair seat back top portion and said second one of said chair support uprights;

wherein said first and second front chair seat support strap members and said first and second chair seat back support strap members are made of a flexible and pliable material; and wherein said first front chair seat support strap member and said first chair seat back support strap member are coupled together in a first coupling region, and wherein said first coupling region forms a pocket configured for being inserted over a topmost region of a first one of said chair support uprights, and wherein said second front chair seat support strap member and said second chair seat back support strap member are coupled together in a second coupling region and wherein said second coupling region forms a pocket configured for being inserted over a topmost region of a second one of said chair support upright.

19. A swinging chair, said swinging chair comprising:

a frame; and a chair seat suspended within said frame and configured for swinging within said frame, said chair seat including a chair seat bottom having a front portion and a rear portion and a chair seat back having a top portion and a bottom portion, wherein said rear portion of said chair seat bottom is coupled to said bottom portion of said chair seat back;

said frame comprising:

first and second chair seat support structures, each of said first and second chair seat support structures including two chair support legs and one chair support upright, said two chair support legs and one chair support upright of each of said first and second chair seat support structures coupled together by means of a hub, wherein said chair support uprights of each of said first and second chair seat support structures include a protrusion on an uppermost end of each of said chair support uprights;

a chair support structure cross-bar, configured for attaching between said first and second hubs of said first and second chair seat support structures, for maintaining said first and second hubs in a predetermined spaced relationship; and a chair seat support mechanism, said chair seat support mechanism comprising a plurality of chair seat front and back flexible support straps, said plurality of chair seat front and back flexible support straps comprising:

first and second chair seat front support strap members, said first chair seat front support strap member coupled between a first side of said chair seat bottom front portion and a first one of said chair support uprights, and said second chair seat front support strap member coupled between a second side of said chair seat bottom front portion and a second one of said chair support uprights; and first and second chair seat back support strap members, said first chair seat back support strap member coupled between a first side of said chair seat back top portion and said first one of said chair support uprights, and said second chair seat back support strap member coupled between a second side of said chair seat back top portion and said second one of said chair support uprights;

wherein said first and second front chair seat support strap members and said first and second chair seat back support strap members are made of a flexible and pliable material; and wherein said first front chair seat support strap member and said first chair seat back support strap member are coupled together in a first coupling region by a first metal coupling member, and wherein said first metal coupling member includes an opening configured for being inserted over said protrusion on an uppermost end of a first one of said chair support uprights, and wherein said second front chair seat support strap member and said second chair seat back support strap member are coupled together in a second coupling region by a second metal coupling member, and wherein said second metal coupling member includes an opening configured for being inserted over said protrusion on an uppermost end of a second one of said chair support uprights.

20. A swinging chair, said swinging chair comprising:

a frame; and a chair seat suspended within said frame and configured for swinging within said frame, said chair seat including a chair seat bottom having a front portion and a rear portion and a chair seat back having a top portion and a bottom portion, wherein said rear portion of said chair seat bottom is coupled to said bottom portion of said chair seat back;

said frame comprising:

first and second chair seat support structures, each of said first and second chair seat support structures including two chair support legs and one chair support upright, said two chair support legs and one chair support upright of each of said first and second chair seat support structures coupled together by means of a hub, wherein said chair support uprights of each of said first and second chair seat support structures include a protrusion on an uppermost end of each of said chair support uprights;

a chair support structure cross-bar, configured for attaching between said first and second hubs of said first and second chair seat support structures, for maintaining said first and second hubs in a predetermined spaced relationship; and a chair seat support mechanism, said chair seat support mechanism comprising a plurality of chair seat front and back flexible support straps, said plurality of chair seat front and back flexible support straps comprising:

first and second chair seat front support strap members, said first chair seat front support strap member coupled between a first side of said chair seat bottom front portion and a first one of said chair support uprights, and said second chair seat front support strap member coupled between a second side of said chair seat bottom front portion and a second one of said chair support uprights; and first and second chair seat back support strap members, said first chair seat back support strap member coupled between a first side of said chair seat back top portion and said first one of said chair support uprights, and said second chair seat back support strap member coupled between a second side of said chair seat back top portion and said second one of said chair support uprights;

wherein said first and second front chair seat support strap members and said first and second chair seat back support strap members are made of a flexible and pliable material;

wherein said first front chair seat support strap member and said first chair seat back support strap member are coupled together in a first coupling region by a first metal coupling member, and wherein said first metal coupling member includes an opening configured for being inserted over said protrusion on an uppermost end of a first one of said chair support uprights, and wherein said second front chair seat support strap member and said second chair seat back support strap member are coupled together in a second coupling region by a second metal coupling member, and wherein said second metal coupling member includes an opening configured for being inserted over said protrusion on an uppermost end of a second one of said chair support uprights and wherein said first chair seat back support strap member comprises first and second flexible seat back support strap elements, said first flexible seat back support strap element of said first chair seat back strap support member coupled proximate a first end directly to a top portion of a first side of said chair seat back, and said second flexible chair seat back support strap element of said first chair seat back support strap member coupled proximate a first end directly to a bottom portion of said chair seat back, and wherein a second end of said first flexible chair seat back support strap element and said second flexible chair seat back support strap element of said first seat back support member are coupled to said first metal coupling member, wherein said second chair seat back support strap member comprises first and second flexible chair seat back support strap elements, said first flexible chair seat back support strap element of said second chair seat back support strap member coupled proximate a first end directly to a top portion of a second side of said chair seat back, and said second flexible chair seat back support element of said second chair seat back support strap member coupled proximate a first end directly to a bottom portion of said chair seat back, and wherein a second end of said first flexible chair seat back support strap element and said second flexible chair seat back support strap element of said second chair seat back support strap member are coupled to said second metal coupling member, and wherein said first and second metal coupling members allow said first and second flexible chair seat back support strap elements of each of said first and second chair seat back support strap members to be adjusted relative to one another causing an angle of the seat back to be adjusted vis-à-vis the chair seat bottom.

* * * * *